US012085289B2

(12) United States Patent
Small, III

(10) Patent No.: US 12,085,289 B2
(45) Date of Patent: Sep. 10, 2024

(54) METHOD OF INSTALLING A UNIVERSAL AIR HANDLER

(71) Applicant: Terrell Jackson Small, III, Fort Worth, TX (US)

(72) Inventor: Terrell Jackson Small, III, Fort Worth, TX (US)

( * ) Notice: Subject to any disclaimer, the term of this patent is extended or adjusted under 35 U.S.C. 154(b) by 634 days.

(21) Appl. No.: 17/346,270

(22) Filed: Jun. 13, 2021

(65) Prior Publication Data

US 2021/0302033 A1 Sep. 30, 2021

Related U.S. Application Data

(60) Division of application No. 16/388,687, filed on Apr. 18, 2019, now Pat. No. 11,073,292, which is a (Continued)

(51) Int. Cl.
*F24F 1/022* (2019.01)
*A47C 4/54* (2006.01)
(Continued)

(52) U.S. Cl.
CPC ..... *F24F 1/022* (2013.01); *A47C 4/54* (2013.01); *A47C 27/081* (2013.01);
(Continued)

(58) Field of Classification Search
CPC .... F24F 13/20; F24F 1/00; F24F 13/28; F24F 13/32; F24F 1/022; F24F 13/0209;
(Continued)

(56) References Cited

U.S. PATENT DOCUMENTS 3,855,814 A * 12/1974 Eubank ..... B60H 1/3226 62/239
4,151,726 A * 5/1979 Schlueter ..... F24F 13/22 62/286

(Continued)

FOREIGN PATENT DOCUMENTS

JP 2012001215 A * 1/2012

*Primary Examiner* — Frantz F Jules
*Assistant Examiner* — Martha Tadesse
(74) *Attorney, Agent, or Firm* — Guy V. Manning, Esq.

(57) ABSTRACT

A method for installing a universal air handler for a building air conditioning system includes installing a compact outdoor cabinet having a blower and separate intake and outlet chambers separated by an evaporator core. Cool and return air ducts from the building couple to each chamber. Return air drawn by the blower into the return air chamber passes across the evaporator, then through the blower and out through the cool air duct. Coolant lines couple the evaporator to a nearby stand-alone condenser/compressor unit. In one embodiment, an adapter enables stacking the condenser/compressor unit atop the cabinet to reduce the footprint of the combination. In another embodiment, a manifold couples permanently to the building air ducts and releasably couples to the cabinet. The universal air handler easily decouples from the manifold for transportation and maintenance. The manifold may be installed in various locations around the building, including on the roof.

12 Claims, 20 Drawing Sheets

Related U.S. Application Data continuation of application No. 15/312,638, filed as application No. PCT/US2015/032324 on May 23, 2015, now Pat. No. 10,309,661.

(60) Provisional application No. 62/002,727, filed on May 23, 2014.

(51) Int. Cl.

| | |
|---|---|
| ***A47C 27/08*** | (2006.01) |
| ***A63H 33/00*** | (2006.01) |
| ***E04H 4/00*** | (2006.01) |
| ***F24F 1/00*** | (2019.01) |
| ***F24F 13/02*** | (2006.01) |
| ***F24F 13/20*** | (2006.01) |
| ***F24F 13/28*** | (2006.01) |
| ***F24F 13/32*** | (2006.01) |
| *A63H 27/10* | (2006.01) |

(52) U.S. Cl.

CPC ..... *A47C 27/087* (2013.01); *A63H 33/00* (2013.01); *E04H 4/00* (2013.01); *E04H 4/0025* (2013.01); *F24F 1/00* (2013.01); *F24F 13/0209* (2013.01); *F24F 13/20* (2013.01); *F24F 13/28* (2013.01); *F24F 13/32* (2013.01); *A63H 2027/1025* (2013.01); *F24F 2221/16* (2013.01); *F24F 2221/17* (2013.01)

(58) Field of Classification Search

CPC ..... A47C 27/081; A47C 4/54; A47C 27/087; E04H 4/0025; E04H 4/00

See application file for complete search history.

(56) References Cited

U.S. PATENT DOCUMENTS

| | | | | | |
|---|---|---|---|---|---|
| 4,337,823 | A * | 7/1982 | DelPercio | F24H 3/062 | 165/53 |
| 5,255,969 | A * | 10/1993 | Cox | F24F 13/20 | 52/631 |
| 5,396,782 | A * | 3/1995 | Ley | F24F 13/32 | 62/297 |
| 5,582,026 | A * | 12/1996 | Barto, Sr. | F24F 1/0003 | 62/298 |
| 10,030,809 | B1 * | 7/2018 | Rowland | F24F 1/60 | |
| 10,094,578 | B1 * | 10/2018 | Metzger, III | B23P 19/04 | |
| 10,309,661 | B2 * | 6/2019 | Small, III | F24F 13/32 | |
| 11,073,292 | B2 * | 7/2021 | Small, III | A47C 27/081 | |
| 2005/0086972 | A1 * | 4/2005 | Hansen | F24F 13/20 | 454/235 |
| 2012/0193505 | A1 * | 8/2012 | Baron | F16F 15/06 | 248/636 |

* cited by examiner

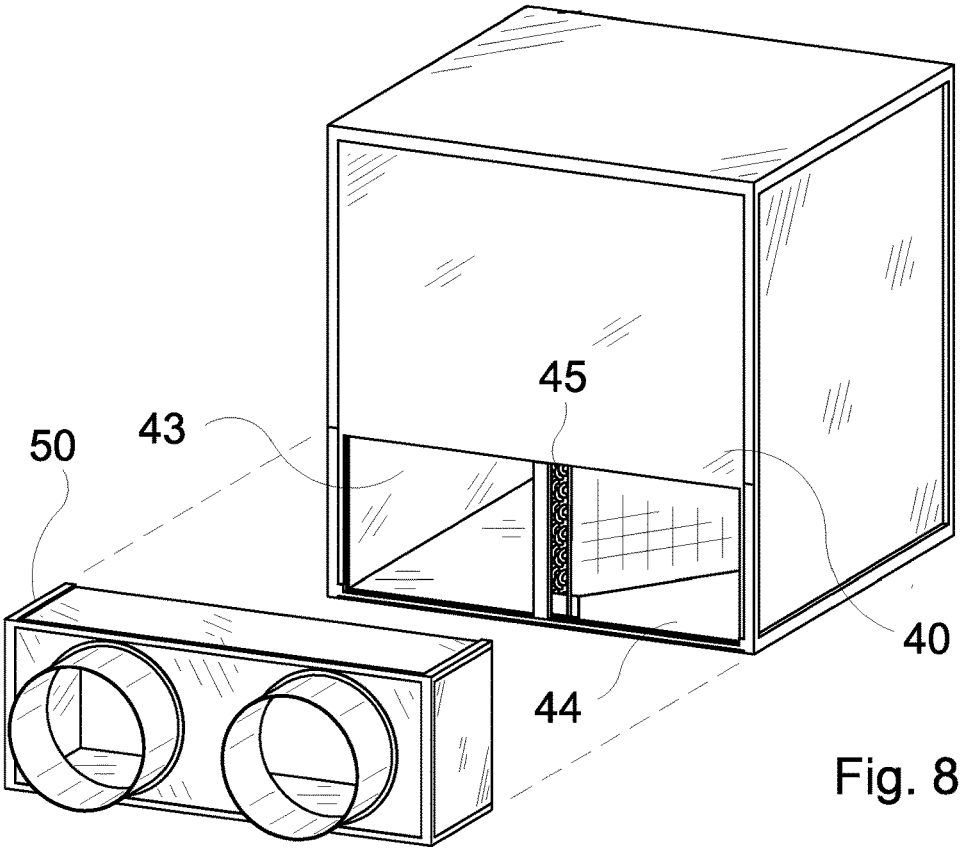
Fig. 8
Fig. 9
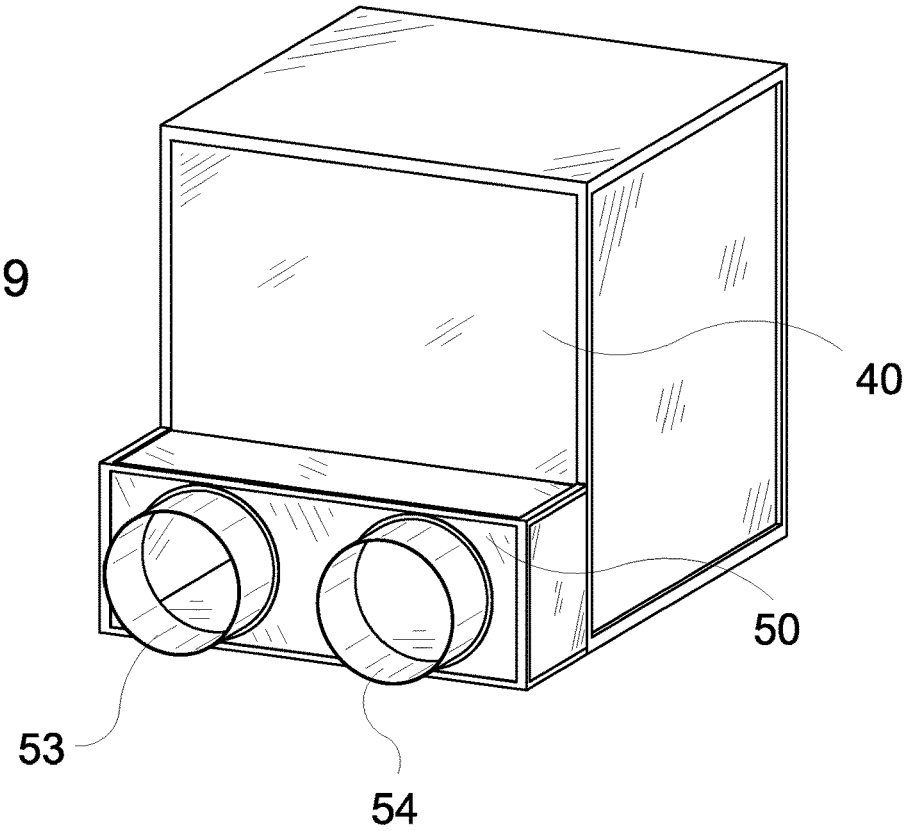

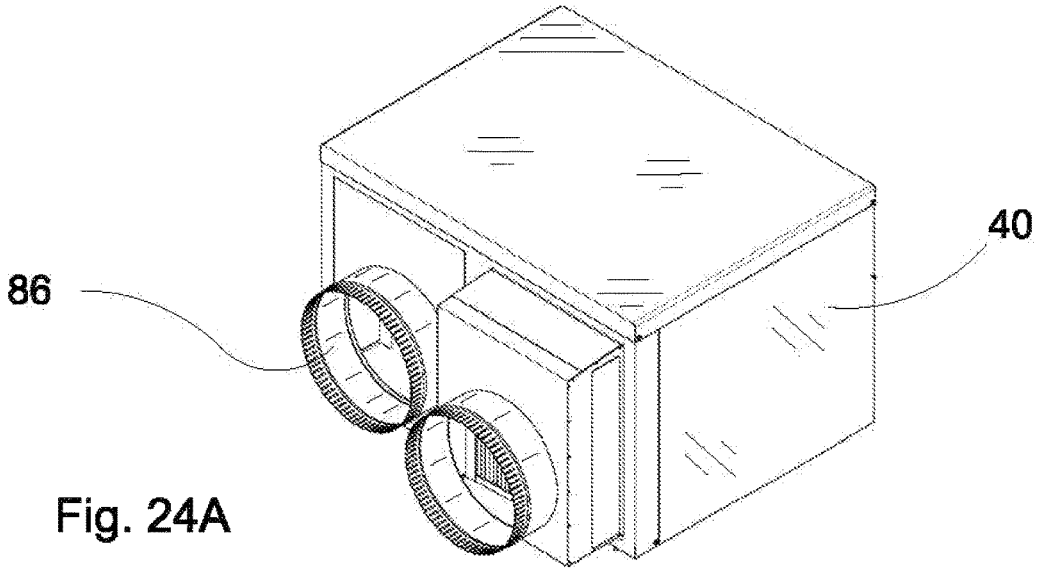
Fig. 24A
Fig. 24B
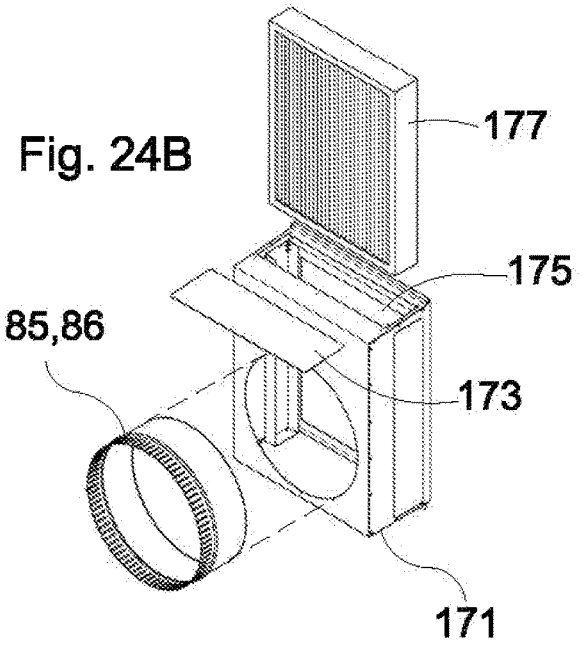
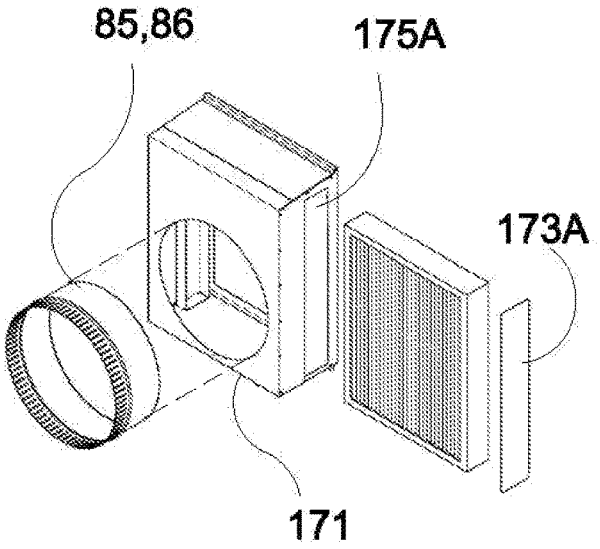
Fig. 24C

METHOD OF INSTALLING A UNIVERSAL AIR HANDLER

This application is a Divisional of and claims domestic benefit from U.S. patent application Ser. No. 16/388,687, filed Apr. 18, 2019, a Continuation of parent U.S. patent application Ser. No. 15/312,638, filed Nov. 19, 2016, as the U.S. National Phase (§ 371) of International Application No. PCT/US15/32324, filed May 23, 2015, which itself claims domestic benefit from U.S. Provisional Application Ser. No. 62/002,747, filed May 23, 2014.

BACKGROUND OF THE INVENTION

1. Field of the Invention

This invention relates generally to air conditioning equipment, and particularly to air conditioning equipment for mobile homes and other small structures. More particularly, this invention relates to a method of installing an outdoor universal air handler for coupling to an adjacent compressor for providing cooling air into small structures from outdoors.

2. Description of Related Art

Private residences and small offices typically employ bifurcated central air conditioning systems usually requiring closet, attic or other indoor space to house the indoor component of the systems, the evaporator coil and blower. The blower impels indoor air from the structure interior across the evaporator for cooling and then through duct work for distribution within the structure. A corresponding outdoor component includes a compressor, condenser coil and fan within a separate outdoor cabinet, usually sitting on a pad adjacent a building wall. Coolant lines carry pressurized coolant (usually freon) between the two units. See FIG. 2.

Interior space in such small structures, and especially in mobile homes, can be comparatively scarce, and such scarcity is aggravated by bifurcated systems. Small structures often don't include attic space, so placing the evaporator and blower in a closet inside becomes the only option. It would be preferable to eliminate the need for dedicated indoor space in such structures.

This, of course, is not a new problem, and the air conditioning industry developed a widely popular solution, called a package unit, for mobile home installations. Package units include all four air conditioner components in a single cabinet resting on a pad adjacent an exterior wall of the mobile home. See FIGS. 3-4B. Two flexible ducts, for cool and return air, couple between the outdoor package unit and the mobile home duct work, thereby eliminating the need for dedicated interior closet or attic space for the evaporator/blower component.

Requirements for greater energy efficiency in residential and small commercial air conditioning systems have developed in recent years, however, and the physical size of compressors and condenser units have grown correspondingly. This has reached a point where, at least in crowded mobile home parks, there simply isn't space between mobile homes for a large enough package unit. The interim solution has been to return to using bifurcated systems for mobile homes, again requiring interior space for evaporator and blower units. A need exists for means to conserve interior space while using higher efficiency outdoor condenser and compressor units.

SUMMARY OF THE INVENTION

A method for installing a universal air handler for a building air conditioning system includes installing a compact outdoor cabinet having a blower and separate intake and outlet chambers separated by an evaporator core. Cool and return air ducts from the building couple to each chamber. Return air drawn by the blower into the return air chamber passes across the evaporator, then through the blower and out through the cool air duct. Coolant lines couple the evaporator to a stand-alone condenser/compressor unit. In one embodiment, an adapter enables stacking the condenser/compressor unit atop the cabinet to reduce the overall footprint of the combination. In another embodiment, a manifold couples permanently to the building air ducts and releasably couples to the cabinet. The universal air handler unit easily decouples from the manifold for transportation and maintenance. The manifold may be installed in various locations around the building, including on the roof.

BRIEF DESCRIPTION OF THE DRAWINGS

The novel features believed characteristic of the present invention may be set forth in appended claims. The invention itself, as well as a preferred mode of use and further objects and advantages thereof, will best be understood by reference to the following detailed description of an illustrative embodiment when read in conjunction with the accompanying drawings, wherein:

FIG. 8 details intake and exhaust interfaces of the universal air handler unit of FIG. 5.

FIG. 9 shows one embodiment of a manifold system adapted for use with the present invention.

FIGS. 24A-24C detail an optional outdoor filter module for use with one embodiment of the present invention.

DESCRIPTION OF A PREFERRED EMBODIMENT

Figure 1:
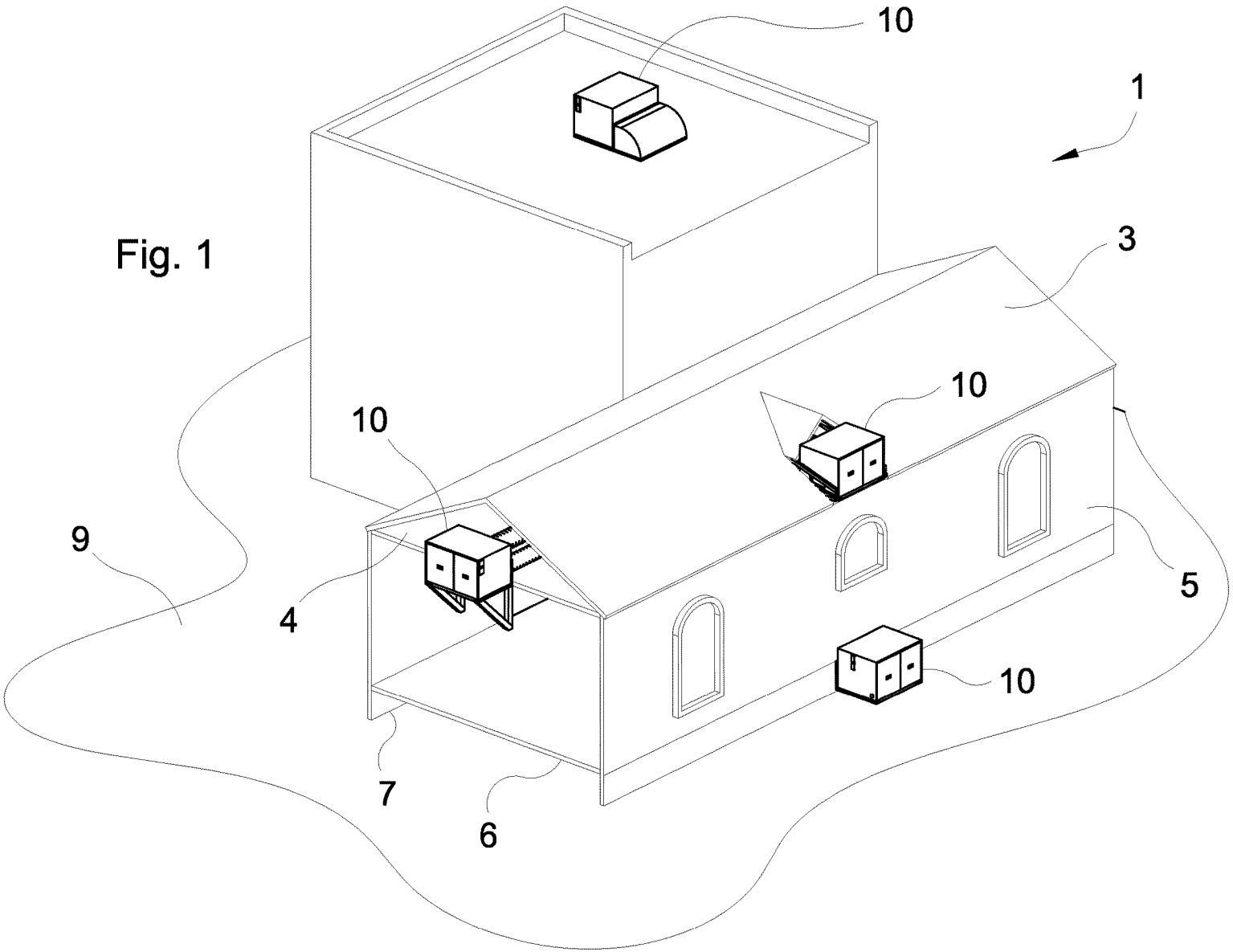
FIG. 1 depicts a typical small structure, such as a mobile home, with which the present invention may be used according to illustrated multiple alternative installation options.
Figure 3:
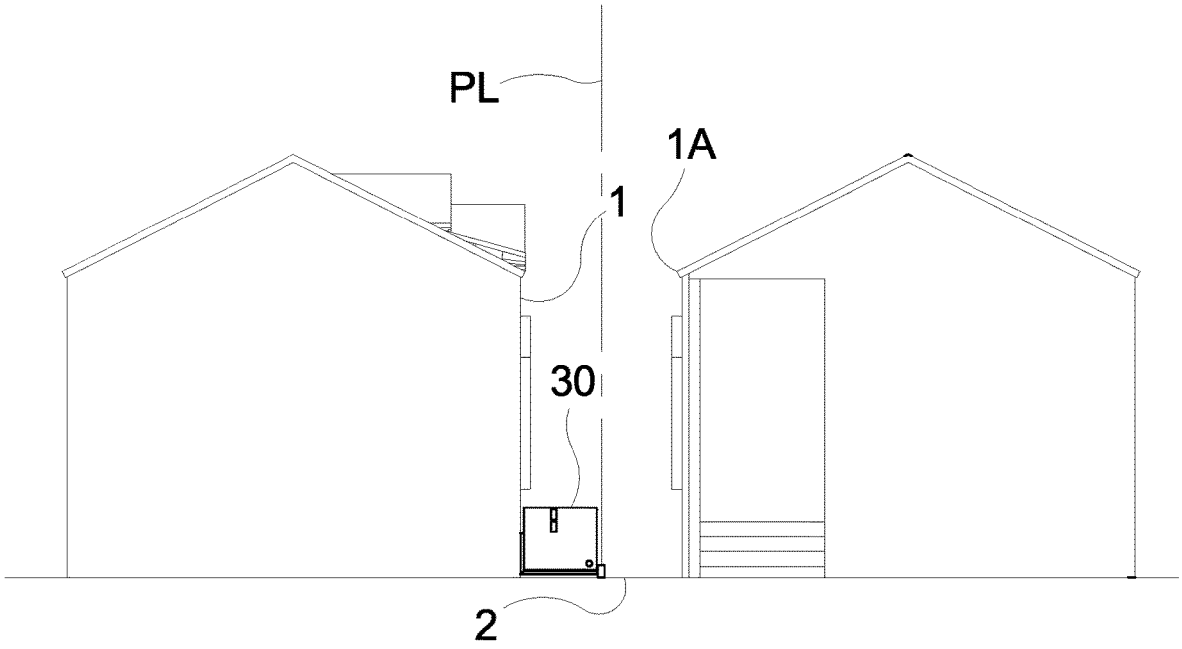
FIG. 3 details the crowded conditions common in mobile home parks.

Referring now to the figures, and particularly to FIGS. 1, 3, mobile home 1 comprises a substantially rectangular structure having vertical walls 5 and shallow-pitched roof 3 terminating in gable 4. Mobile homes 1 typically are elevated a spaced distance above ground 9 to form crawl space 7 beneath floor 6. Many utilities serving mobile home 1 extend through crawl space 7 to various entry points (not shown) through floor 6. This often includes flexible cool and return air conditioning ducts 33, 34 (see, e.g., FIGS. 5-7) discussed in more detail below. Crawl space 7 commonly is surrounded by a shroud, or skirt (not shown) to inhibit intrusion into crawl space 7 by small animals and to control air circulation for better insulation of mobile home 1 beneath floor 6.

Unlike with large homes having tall roof lines, gable 4 and roof 3 typically do not define an attic space for mobile home 1 but instead typically define an elevated, or vaulted ceiling (not shown), thus providing no attic space for installation of the interior component of a bifurcated air conditioning system. See FIG. 2. Alternately, if gable 3 does include attic space, it usually is very small and inadequate to contain the indoor equipment. One having ordinary skill in the art will recognize that the structure depicted in FIG. 1 could represent residential or small commercial structures other than mobile home 1 without departing from the spirit and scope of the present invention, and that the present invention may be used with all such other structures.

Figure 2:
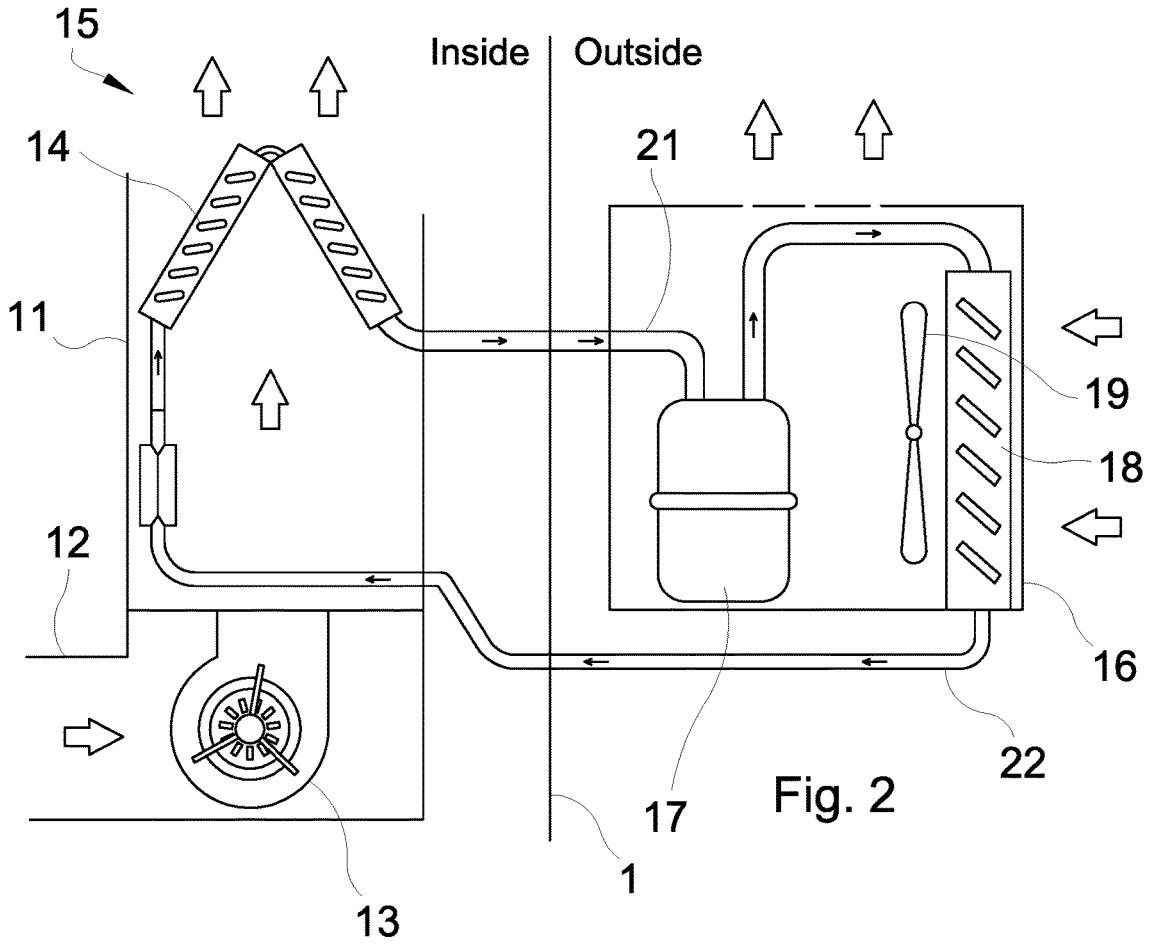
FIG. 2 is a schematic of a typical bifurcated air conditioning system according to prior art.

Turning now also to FIG. 2, air conditioning system 10 provides cooled air to the interior of mobile home 1, usually through interior duct work 15 extending throughout mobile home 1. The schematic of FIG. 2 represents the typical, bifurcated system. One portion of system 10 includes compressor 17, condenser 18 and condenser blower 19 contained within outdoor cabinet 16, typically resting on pad 23 (FIGS. 5, 6) adjacent crawl space 7 along exterior wall 5. The remainder of system 10 is housed indoors, commonly in closet 11 or attic space (not shown). The indoor component includes blower 13 which impels interior air drawn from intake 12 into duct work 15 after passing through and being cooled by evaporator coils 14. Pressurized coolant lines 21, 22 convey coolant (typically freon) between the indoor and outdoor components of system 10, lines 21, 22 commonly being dozens of feet in length and vulnerable to damage from impacts and elements. Thus, significant space within the interior of mobile home 1 necessarily is dedicated to the indoor component of system 10.

Figure 4A:
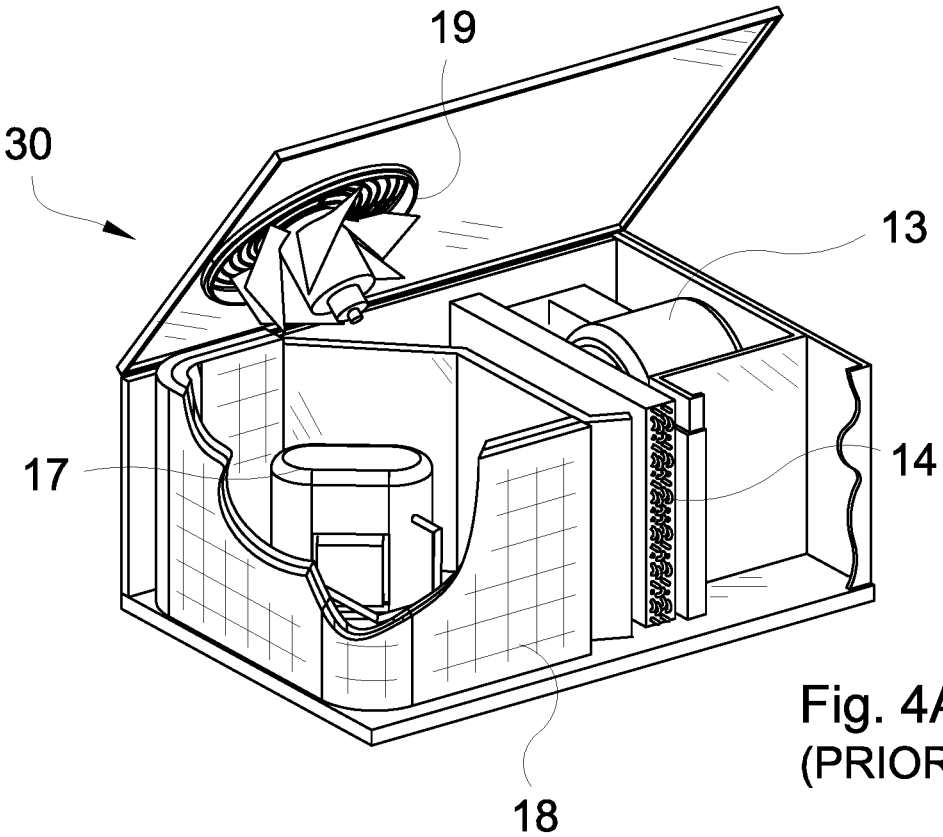
Fig. 4A (PRIOR ART)
FIGS. 4A, 4B depict an air conditioning package unit according to prior art.
Figure 4B:
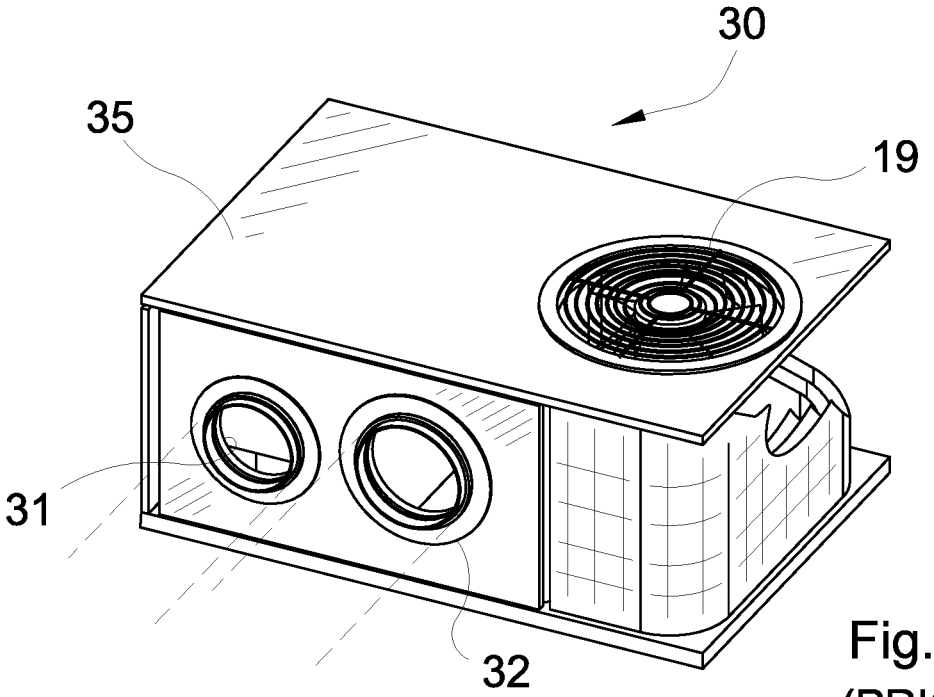
Fig. 4B (PRIOR ART)

Turning now also to FIGS. 4A, 4B, package unit 30 was developed among other reasons to liberate interior space within mobile home 1 occupied by system 10's indoor component. Package unit 30 contains entire system 10 within single, outdoor cabinet 35 resting on pad 23 (see FIG. 6) juxtaposed crawl space 7. Cool and return air ports 31, 32 couple to a chamber within cabinet 35 which contains evaporator 14 and blower 13. Air drawn by blower 13 from mobile home 1 through intake 32 passes across evaporator 14 and returns as cool air through outlet 31 and into mobile home 1. Intake 32 and outlet 31 are disposed on one side of cabinet 35 adjacent wall 5, and couple to flexible ducts 33,34 (see FIG. 7) which extend through crawl space 7 to couple to duct 15 without requiring dedication of closet 11 to system 10.

As best seen in FIG. 3, package unit 30 is compact enough to fit adjacent to and within curtilage 2 of mobile home 1 without encroaching upon the curtilage of adjacent mobile home 1A. As discussed above, however, as energy efficiency requirements cause the size of package units 30 to increase, it becomes increasingly difficult to fit such all-in-one units into curtilage 2. Adding to this difficulty, mobile home park owners have decreased curtilage 2 to the point that even earlier, prior art package units 30 have become difficult to install and maintain.

Figure 7:
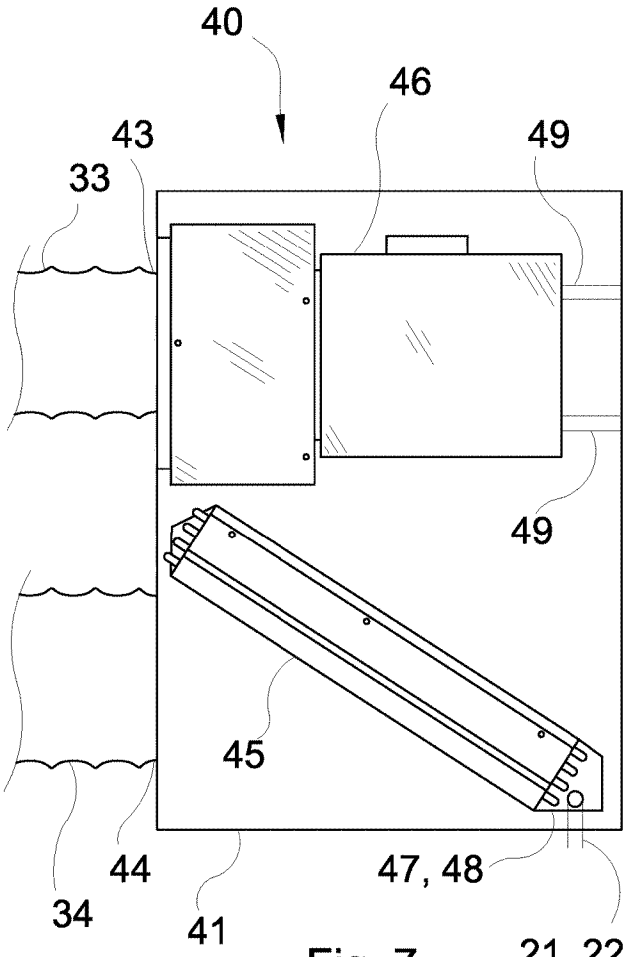
FIG. 7 is a plan view of the universal air handler unit of FIG. 5 showing its interior components.
Figure 6:
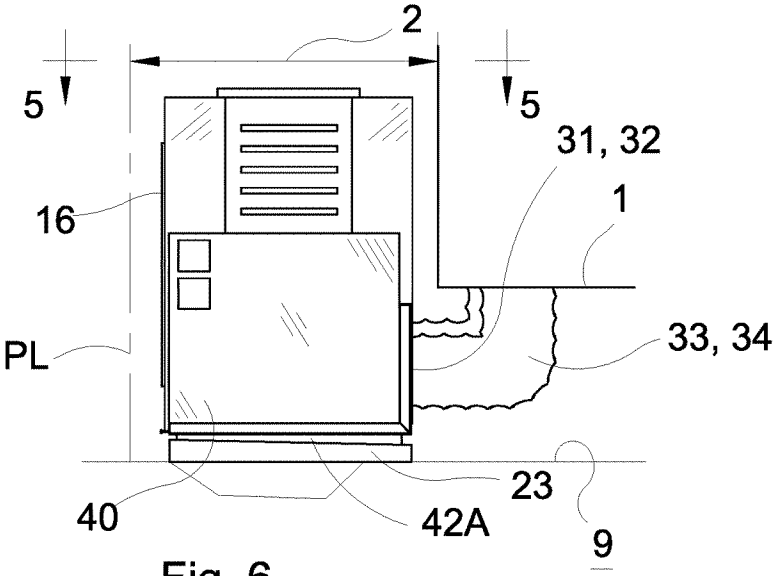
FIG. 6 is an elevation view of the installation of FIG. 5
Figure 5:
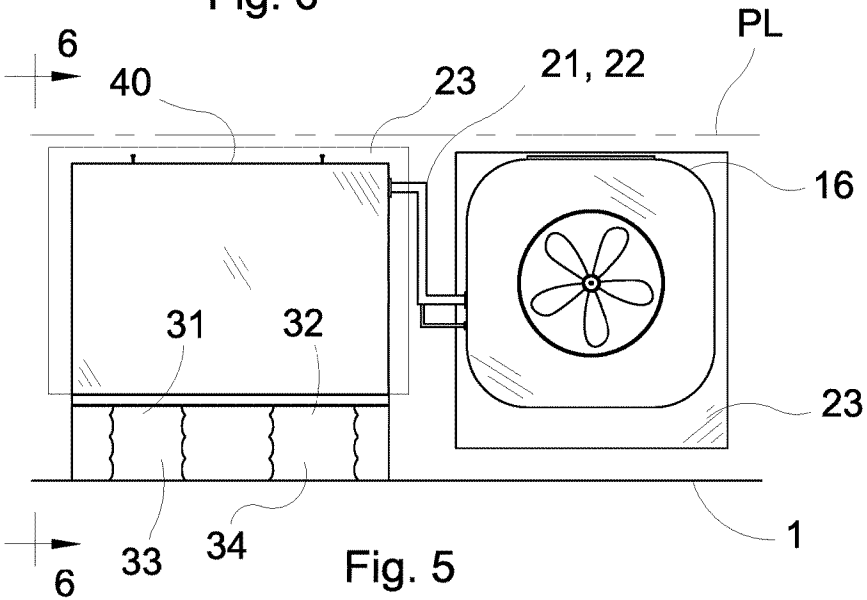
FIG. 5 is a plan view of an installation adjacent a mobile home using the universal air handler unit of the present invention.
Figure 11:
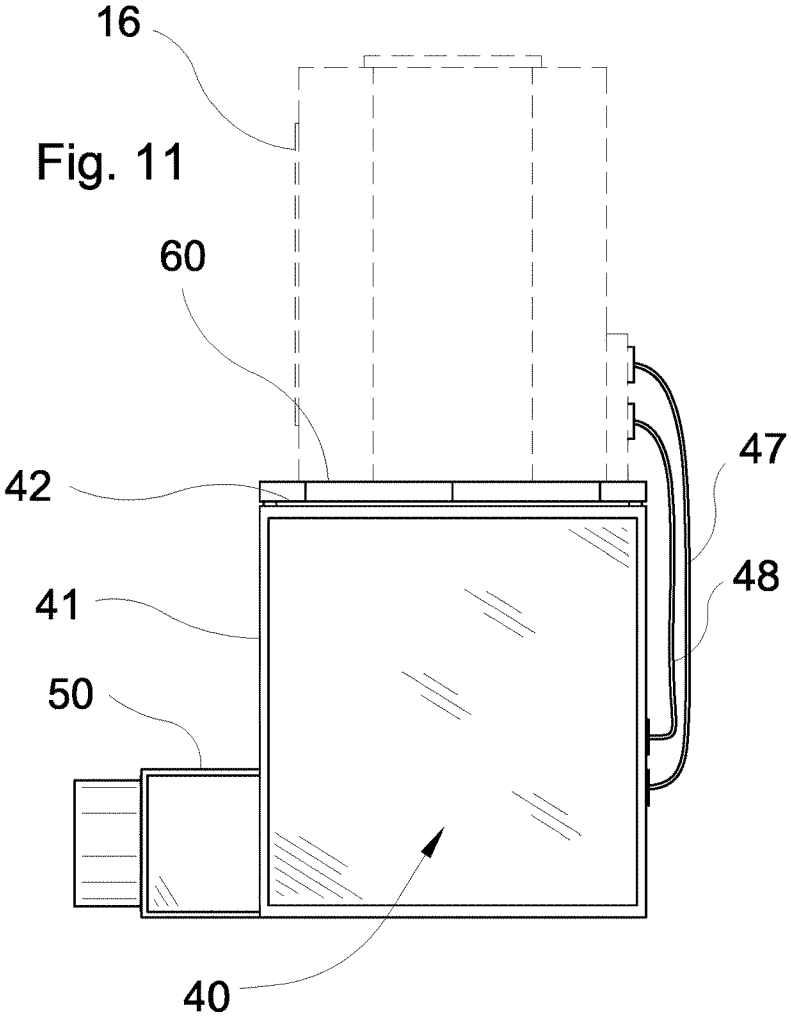
FIGS. 10, 11 show, in quartering perspective and side elevational views respectively, an X-bracket used for stacking a condenser unit atop the present invention.
Figure 10:
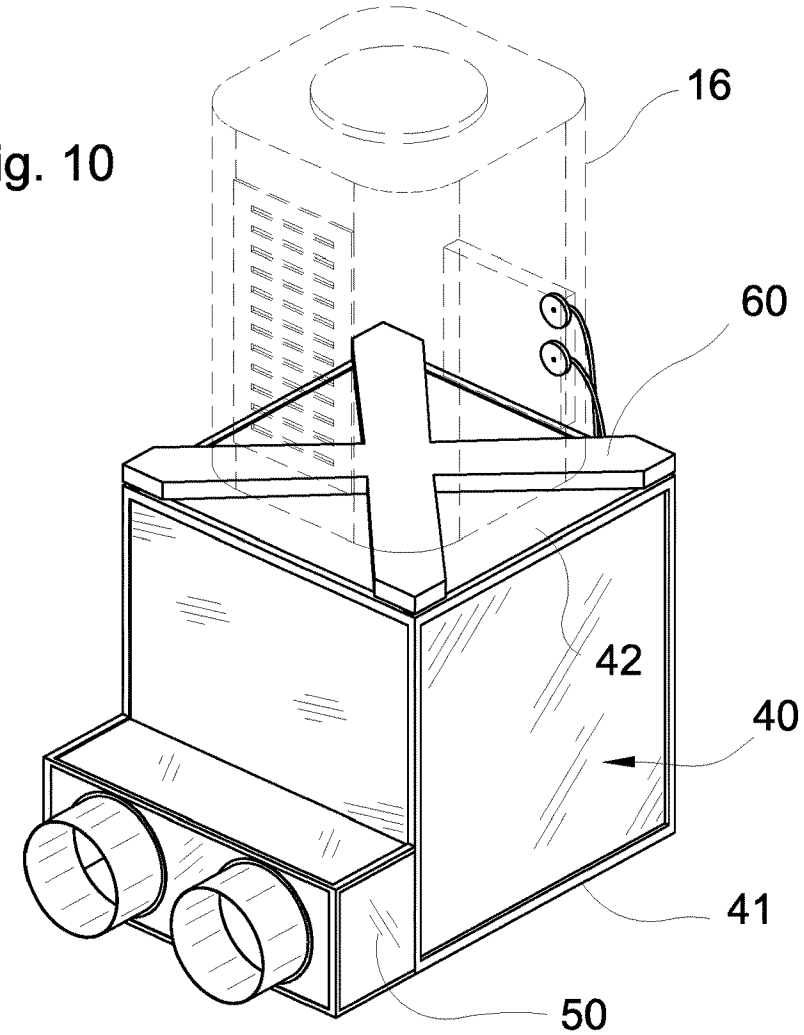

As best seen in FIGS. 5-7, the present invention 40 relieves this curtilage 2 constriction problem by again segregating the evaporator/blower portion of system 10 from the condenser/compressor portion, but enclosing the former into outdoor cabinet 41 adapted also to be disposed outdoors adjacent wall 5 and coupled to flexible ducts 33, 34. Exterior coolant ports 47, 48 couple to coolant lines 21, 22 extending to a separate, stand-alone condenser/compressor unit 16 installed nearby.

Two advantages arise from this arrangement. First, the overall horizontal size of two separate units of currently acceptable capacity now fit well within curtilage 2. Second, universal air handling unit 40 of the present invention may be used with a variety of condenser/compressor units without the two necessarily being manufactured or supplied by the same business entity, as with package unit 30. This gives homeowners and air conditioning contractors greater flexibility to take advantage of competitive pricing among manufacturers of outdoor component units 16, and enables use of units 16 from other applications, such as larger homes.

As best seen in FIG. 7, universal air handling unit 40 comprises a substantially rectangular cabinet partially divided by evaporator 45. Warm air from mobile home 1 enters intake port 44 coupled to return air flexible duct 34 and is drawn across evaporator 45 by the suction of blower 46 which impels the cooled air back out through outlet 43, into cool air flexible duct 33 and thereby into mobile home 1. One having ordinary skill in the art will recognize that evaporator 45 forms an airtight barrier between intake 44 and blower 46, thereby requiring air entering intake 44 to pass through evaporator 45 and not allowing it to bypass evaporator 45. One having ordinary skill in the art also will recognize that the size of evaporator 45 and blower 46 are selected based on the size of the space to be cooled within mobile home 1, just as with the prior art, and cabinet 41 sized to contain them.

Figure 21A:
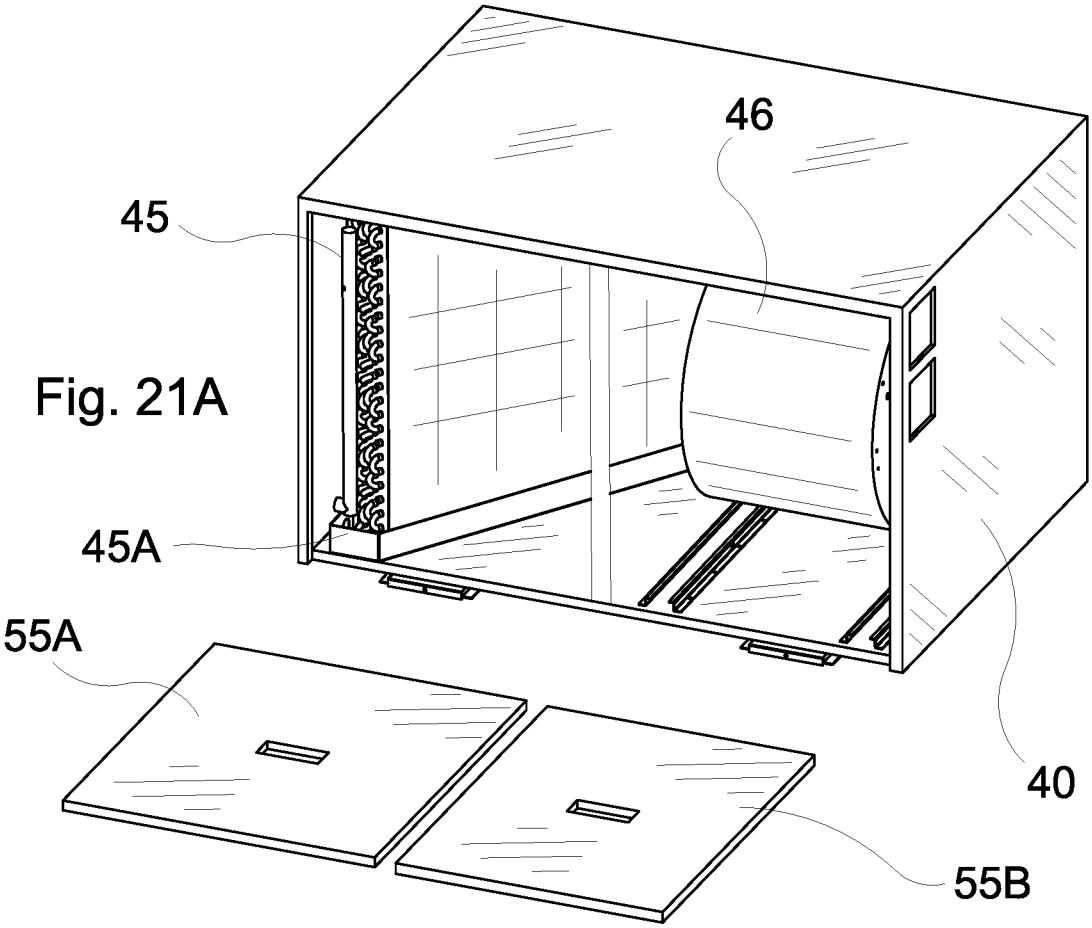
FIGS. 21A, 21B show the blower cabinet rail system within the present invention.
Figure 21B:
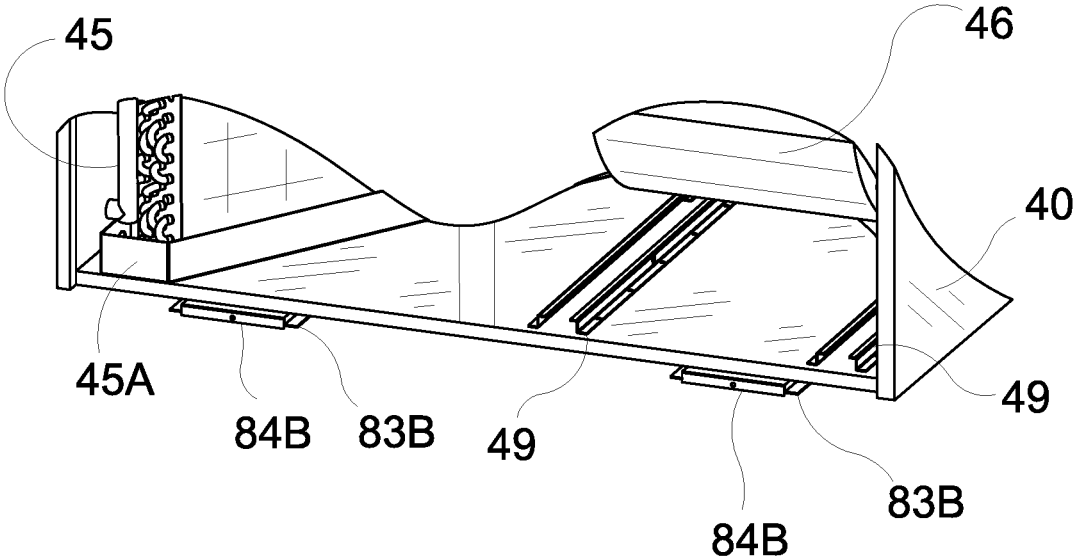

As best seen in FIGS. 21A,21B, a particular embodiment of cabinet 41 includes removable access panels 55A, 55B which provide access to the interior of cabinet 41. This permits easy servicing of blower 46, evaporator 45 and other equipment within cabinet 41. Blower rails 49 may be provided for easy removal and replacement of blower 46 during such servicing activity.

Opposite access panels 55A, 55B and adjacent crawl space 7, similarly removable port panels, preferably of comparable size to access panels 55A, 55B, provide exchangeable mounts for ports 43, 44, enabling an installer to swap out ports 43, 44 for different sized ports 43, 44 to match flexible ducts 33, 34 as required for a given installation.

In a particular embodiment of universal air handler unit 40 depicted in FIGS. 8, 9, manifold 50 couples across intake 44 and outlet 43 to which flexible ducts 33,34 may be permanently affixed. When air handler unit 40 must be serviced, it may be unbolted from manifold 50 and removed to a service area or shop (neither shown), unit 40 either being replaced immediately with a new unit 40 or reinstalled once such service is performed. This also abets relief of space requirements within curtilage 2. By leaving manifold 50 coupled to flexible ducts 33, 34, service personnel need not crawl into nor even open crawl space 7 to uncouple ducts 33,34 from unit 40. Further, flexible ducts 33, 34 can be damaged when they are disturbed, incurring tears, crimps or other injuries which compromise efficiency and even function. By coupling them permanently to manifold 50, such injuries can be minimized or deterred.

With reference now also to FIGS. 24A-24C, optional outdoor filter module 170 may be placed across one or both (not shown) of intake 44 and outlet 43. Filter module 170 comprises filter housing 171 adapted to hold filter 177 across intake 44 or outlet 43 and provide access thereto without the need to enter home 1. FIG. 24B depicts top access to filter 177 through top port 175 sealed by top door panel 173. FIG. 24C depicts side access to filter 177 through side port 175A sealed by side door panel 173A. One having ordinary skill in the art will recognize that either of both the above discussed side and top access could be provided with one housing 171, and that the side on which side port 175A and side door 173A is located depends upon which of intake 44 or outlet 43 is being filtered, and that all such alternatives to filter module 170 are considered to be within the spirit and scope of the present invention.

In another particular embodiment of the present invention shown in FIGS. 10-13B and 25A-25B, unit 40 may be equipped with X-bracket 60, which spans across top 42 of cabinet 41 and permits stacking condenser/compressor unit 16 atop universal air handler 40. Since outdoor components commonly include condenser blower 19 (FIG. 5) expelling hot air vertically upward from within unit 16, they seldom are candidates for supporting unit 40. However, outdoor components typically are much lighter in weight than air handler unit 40, and do not represent a major weight load on cabinet 41. Thus, stacking unit 16 atop unit 40 is realistic, and allows blower 19 to continue to blow hot air upward from unit 16.

X-bracket 60 includes legs 61 which cross approximately equidistant from their respective tips 62 at an angle adapted to dispose tips 62 directly above the four corners of cabinet 41. Keeper plate 66 affixes legs 61 in relative position to each other. As best seen if FIGS. 12A, 12B, tips 62 further are contoured to reflect the general shape of the corners of cabinet 41, typically having beveled edges that form a 90 degree angle, giving tips 62 a plan view profile congruent with the square corners of cabinet 41. One having ordinary skill in the art will recognize that any shapes of tips 62, whether or not they match the plan profile of the corners of cabinet 41, are considered within the spirit and scope of the present invention. Where they cross, legs 61 are notched so that they remain coplanar with each other and comprise a stable platform across the middle of cabinet 41.

Disposed on the underside of tips 62, lugs 63 mate with correspondingly shaped apertures 64 in top 42 to affix X-bracket horizontally to cabinet 41. Lugs 63 extend through apertures 64 in top 42 and engage support structures (not shown) of cabinet 41, such as vertical corner channels forming a skeleton (not shown) of cabinet 41. Preferably, lugs 63 and apertures 64 are substantially L-shaped in the plane of cabinet top 42 and sized to match similar L-shaped metal channels usually used as corner structures of the skeleton of cabinet 41. Keepers (not shown) may be provided for affixing lugs 63 in place within apertures 64, but one having ordinary skill in the art will recognize that the weight of condenser/compressor unit 16 typically will be sufficient to hold lugs 63 in place. Such keepers may take the form of simple screws inserted through the side of cabinet 41 at an appropriate distance below top 42. Such keepers might include set screws (not shown).

Figure 13B:
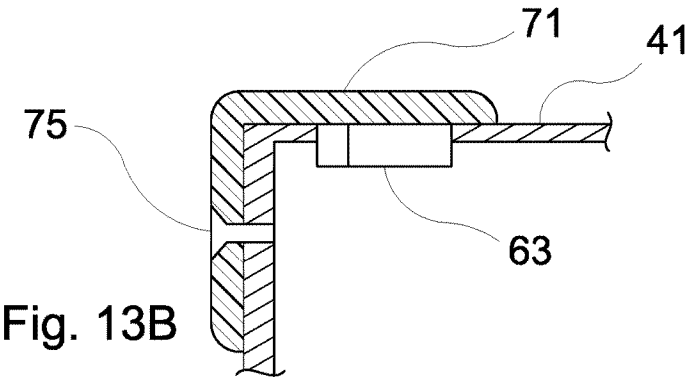
FIGS. 13A, 13B detail a particular embodiment of a corner cap for the universal air handling unit of the present invention when the corner supports of FIGS. 12A, 12B are employed.
Figure 13A:
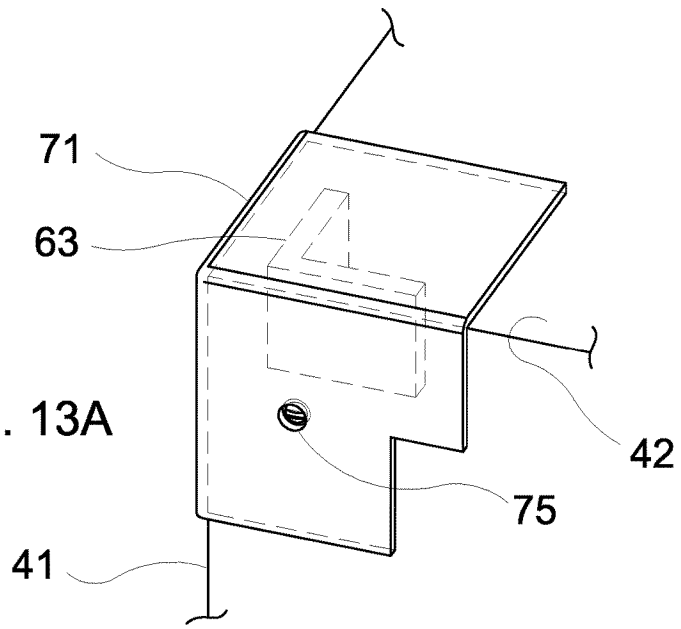
Figure 13C:
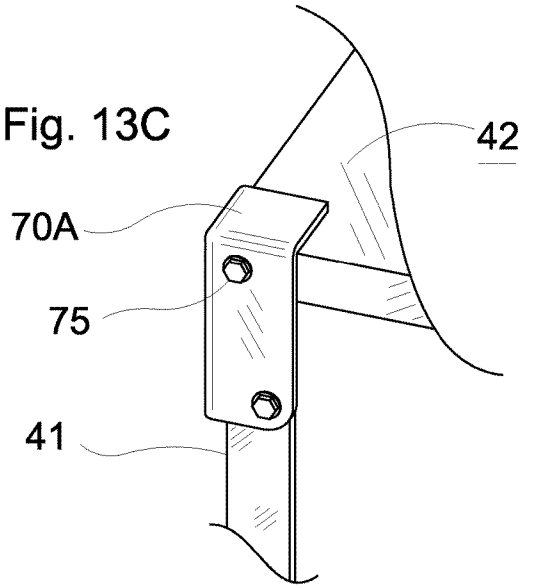
FIGS. 13C, 13D detail an alternate embodiment of a corner cap for use with the corner supports of FIGS. 12C, 12D.
Figure 13D:
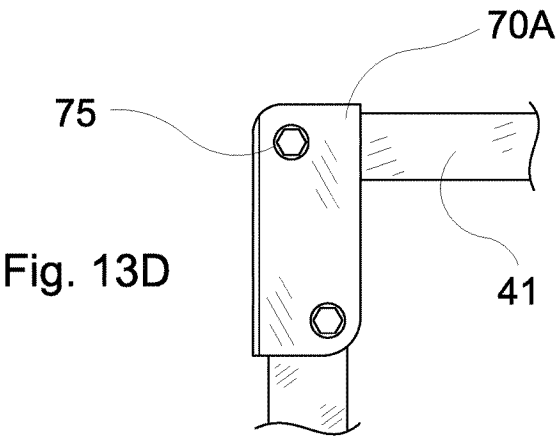

As seen in FIGS. 13A, 13B, corner cap 70 may be provided to close apertures 64 when X-bracket 60 is not employed. Corner cap 70 preferably comprises body 71 adapted to surround two adjacent sides and top 42 of cabinet 41 a spaced distance from its corners. Disposed beneath top 71, aperture plug 73 is adapted to be received and to substantially fill aperture 64, while keeper 75 engages the sides of cabinet 41 to affix corner cap 70 in place. One having ordinary skill in the art will recognize that keepers 75 may be the same keepers used to affix lugs 63 within apertures 64.

Figure 12A:
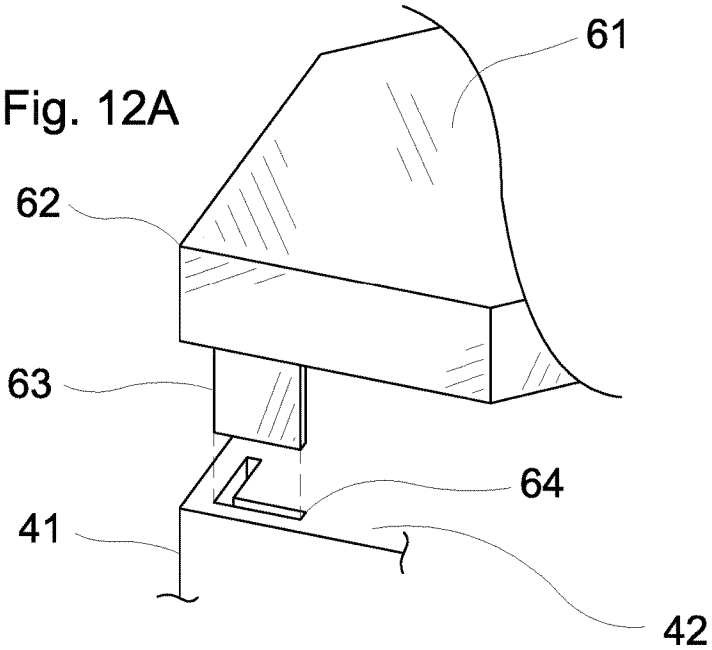
FIGS. 12A, 12B detail a particular embodiment of corner supports of the X-bracket of FIGS. 10, 11.
Figure 12B:
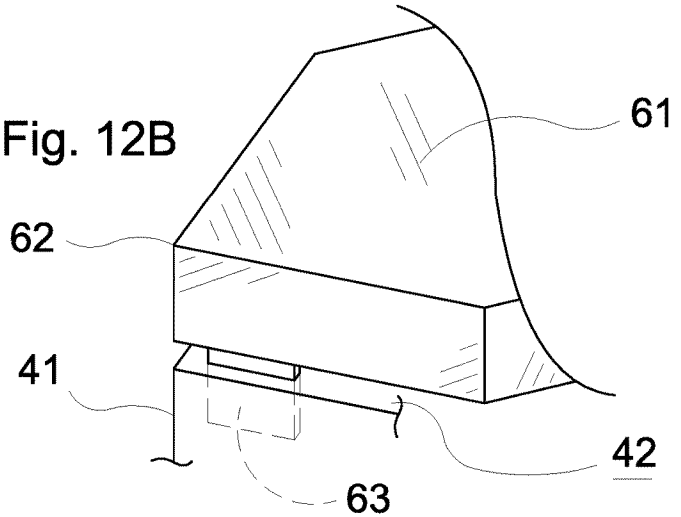
Figure 12C:
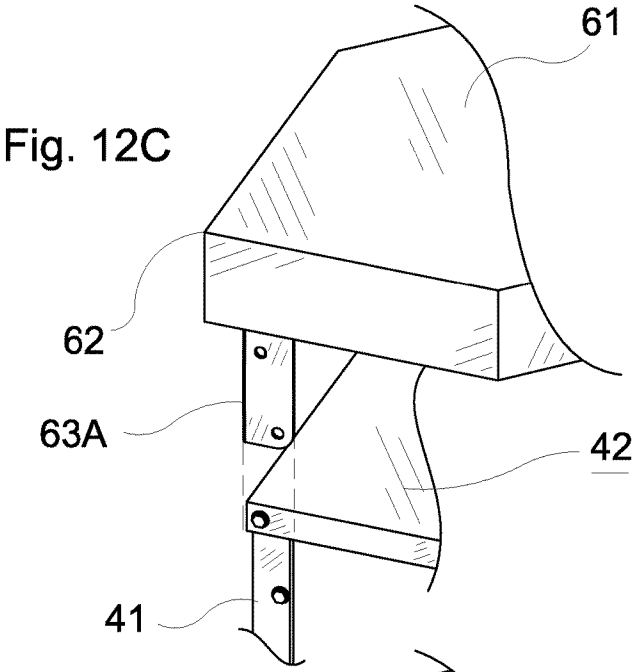
FIGS. 12C, 12D detail another embodiment of corner supports of the X-bracket of FIGS. 10, 11.
Figure 12D:
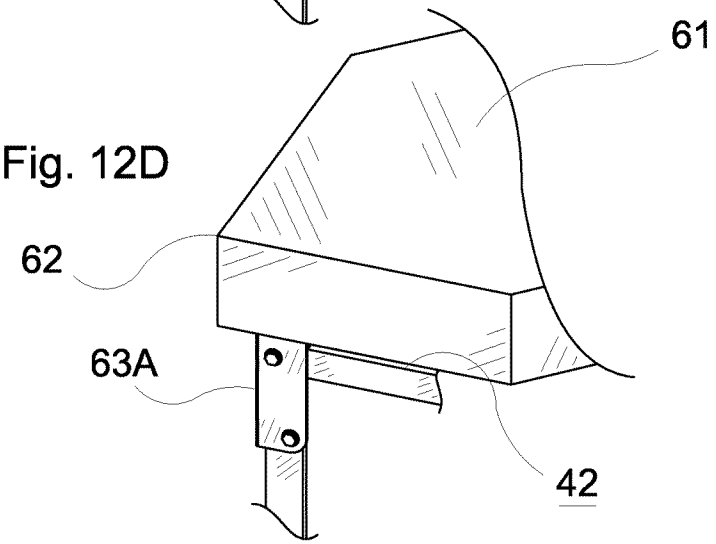
Figure 14:
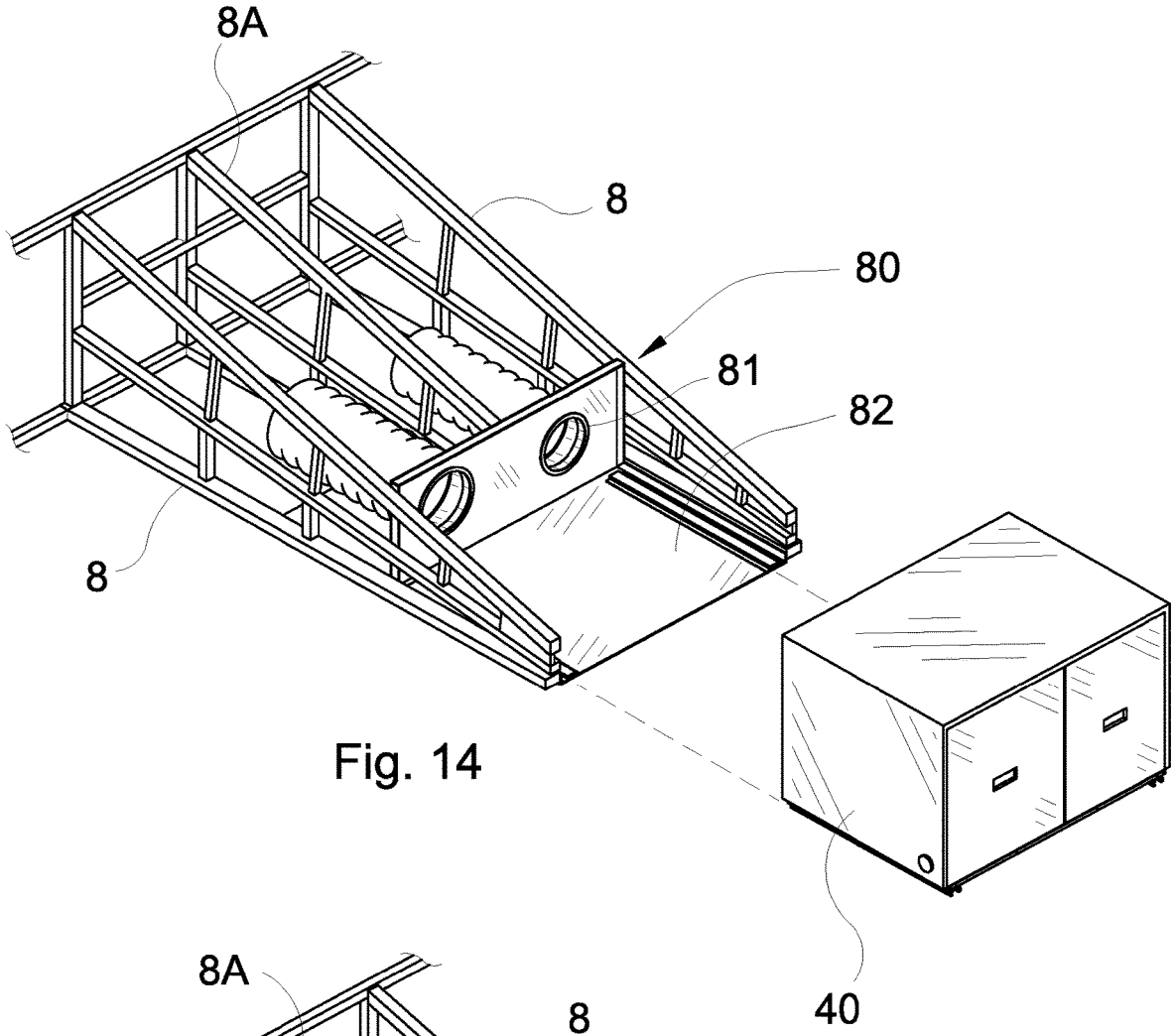
FIGS. 14, 15 show the present invention in use with an alternate embodiment of the manifold system of FIG. 9.
Figure 15:
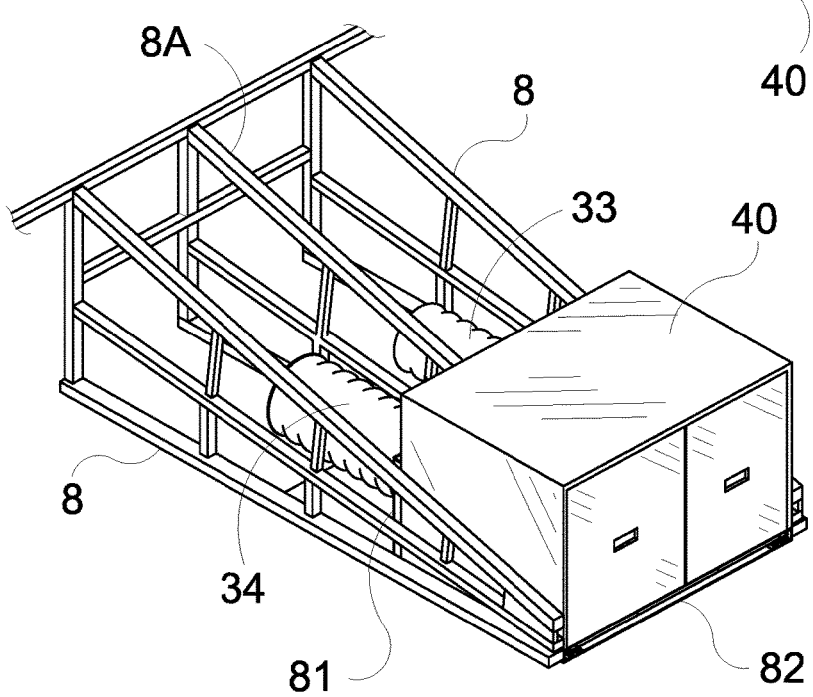
Figure 16:
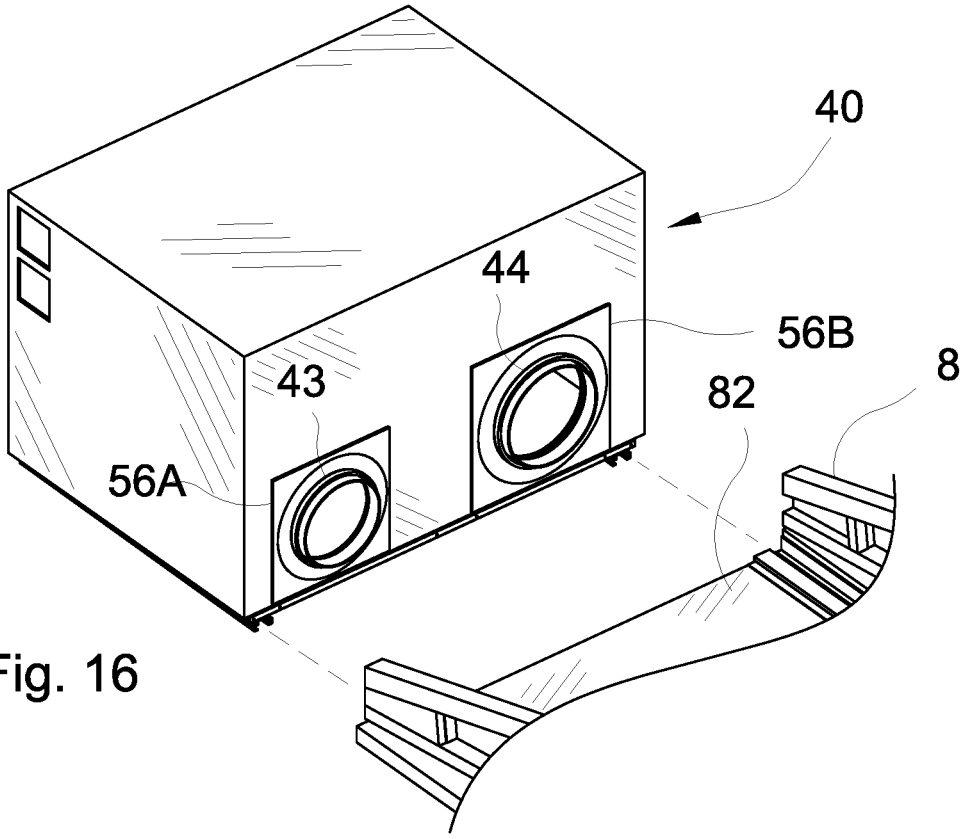
FIGS. 16, 17 detail the alternate manifold system of FIGS. 14, 15.
Figure 17:
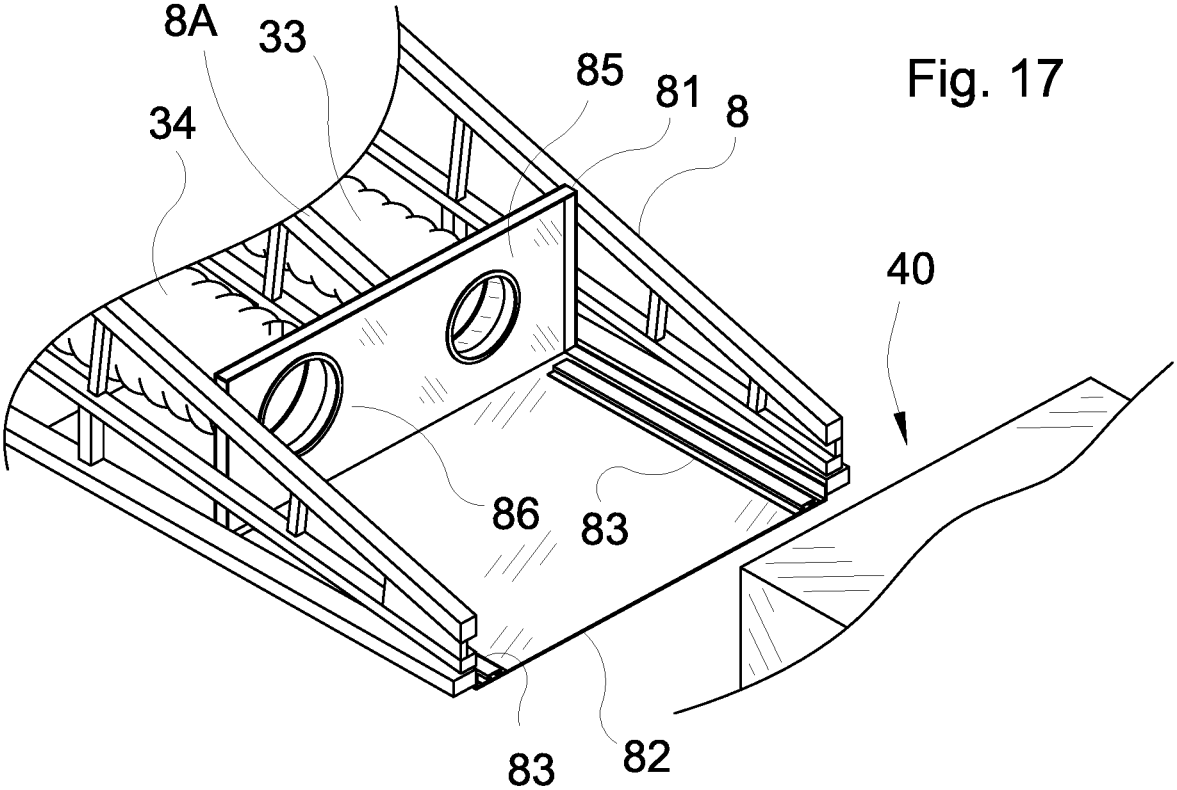

In an alternate embodiment depicted in FIGS. 12C, 12D, lugs 63A depend from tips 62 to cooperate with the corners of cabinet 41 for attachment by bolts 75, without requiring penetration of cabinet top 42 by aperture 64. Instead, lugs 63A mate with bolts 75 to secure X-bracket 60 to cabinet 41. When X-bracket 60 is not in use, corner cap 70A may be affixed to cabinet 41 in place of lugs 63A and held in place by bolts 75. One having ordinary skill in the art will recognize that numerous means of affixing X-bracket 60 to cabinet 41, including some with damping means (not shown) to dampen transmission of vibrations between unit 40 and condenser 16, without departing from the spirit and scope of the present invention.

Referring now also to FIGS. 23A-23D, another alternate embodiment of condenser support means replaces X-bracket 60 with X-mount 160. X-mount 160 includes triangular, opposite end panels 161 which cooperate with opposite side panels 163 to form a rectangular base atop cabinet 41 upon which condenser 16 rests. Panels 161,163 include downwardly extending inner flanges 167 which fasten together along their common lengths to unite panels 161,163 into a rectangular cover sized to fit snugly atop the top surface 42 of cabinet 41.

The resulting beams formed by adjacent and fastened-together inner flanges 167 form an X-truss across the top surface 42 of cabinet 41 sufficient in most cases to support condenser unit 16. If the installer (not shown) deems it important to do so, however, he may reinforce the X-truss with perimeter supports using brackets 162,164 which form a frame around the perimeter of and resting upon top 42. In this configuration, all three sides of panels 161,163 are supported upon top 42. X-mount 160 disassembles into its component parts 161, 163, 162, 164 for convenient shipping and storage in box 165 until needed.

Brackets 162,164 preferably are segments of angle iron sized and oriented to have a vertical leg affixed to the inner surface of outer flange 166 with their other leg lying flat on top surface 42 of cabinet 41. Brackets 162, 164 preferably are not quite as long as perimeter flanges 166, thereby leaving gaps through which moisture may escape if it penetrates beneath panels 161, 163.

When X-mount 160 is in place, perimeter flanges 166 descend past top surface 42 to lay alongside the sides of cabinet 41. Fasteners such as screws (not shown) may be provided to affix perimeter flanges 166 to cabinet 41, but experience has shown that they are unnecessary, perimeter flanges 166 alone, surrounding cabinet 41*a* top surface 42, providing sufficient stability without them.

Preferably, cushioning means in the form of adhesive tape 168 is disposed between the bottom edges of inner flanges 167 and top 42, and, when perimeter brackets 162, 164 are used, the horizontal leg of brackets 162,164. Tape 168 absorbs and dampens vibrations from both condenser unit 16 and cabinet 41. Preferably, tape 168 is one-half (0.5 in.) inch thick by one (1.0 in.) inch wide nitrile/vinyl, single-sided adhesive sponge tape with low thermal conductivity and water absorption. A suitable material for tape 168 is available as a 25/50 Rated Sponge (no product number) from SECON Rubber & Plastics, Inc., of Red Bud, Illinois USA. The adhesive side of tape 168 is applied to the bottom edges of inner flanges 167 and the bottoms of brackets 162, 164.

Turning now also to FIGS. 14-20B, an alternate embodiment of manifold 50 comprises quick coupling manifold 80. Manifold 80 includes horizontal shelf 82 from one end of which rises vertical bulkhead 81. Bulkhead 81 surrounds intake coupler 85 and return coupler 86, discussed in more detail below. Couplers 85, 86 extend through bulkhead 81 and provide flanges to which flexible ducts 33, 34 may be permanently attached.

Figure 18A:
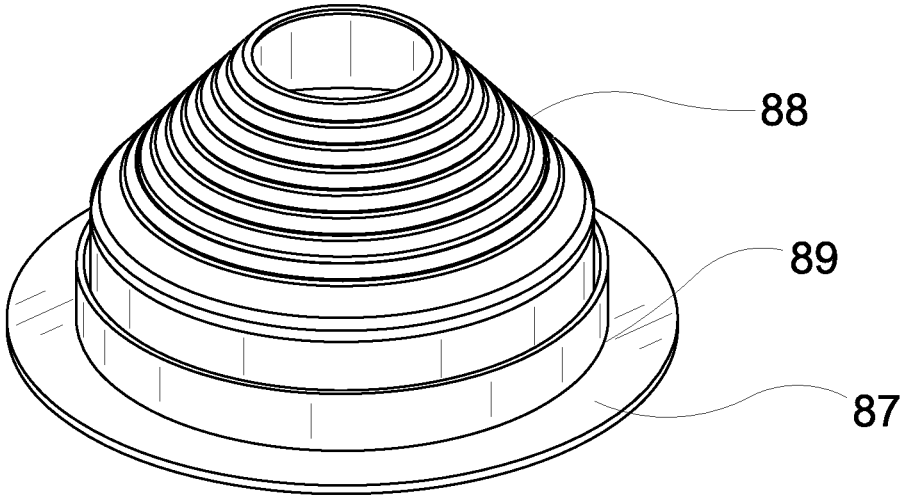
FIGS. 18A-18B detail a quick-coupling manifold system of the alternate embodiment of FIGS. 14-17.
Figure 18B:
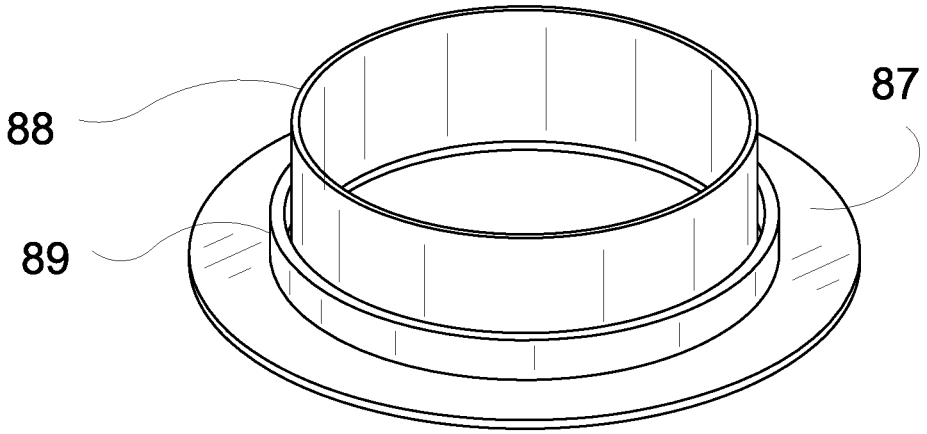
Figure 18C:
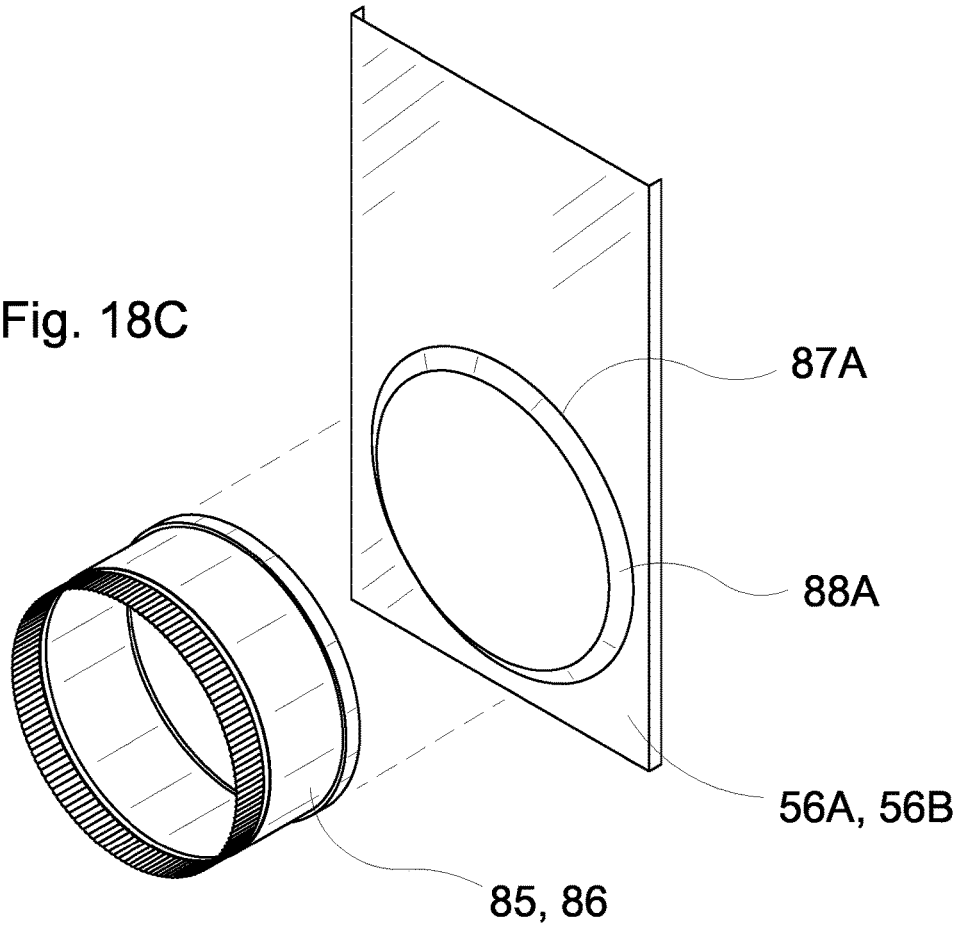
FIG. 18C details a simplified version of the quick-coupling manifold system of the alternate embodiment of FIGS. 14-17.
Figure 19:
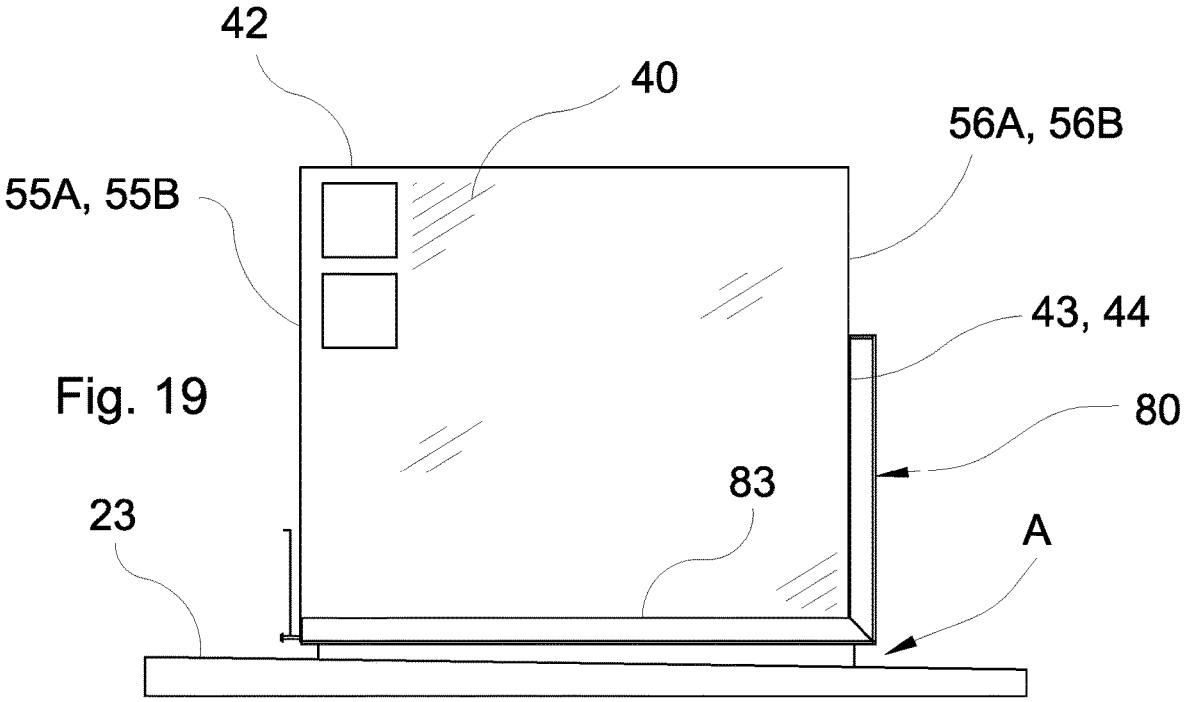
FIG. 19 depicts in side elevational view the present invention resting on a sloping rail system to enhance drainage of condensate.
Figure 20A:
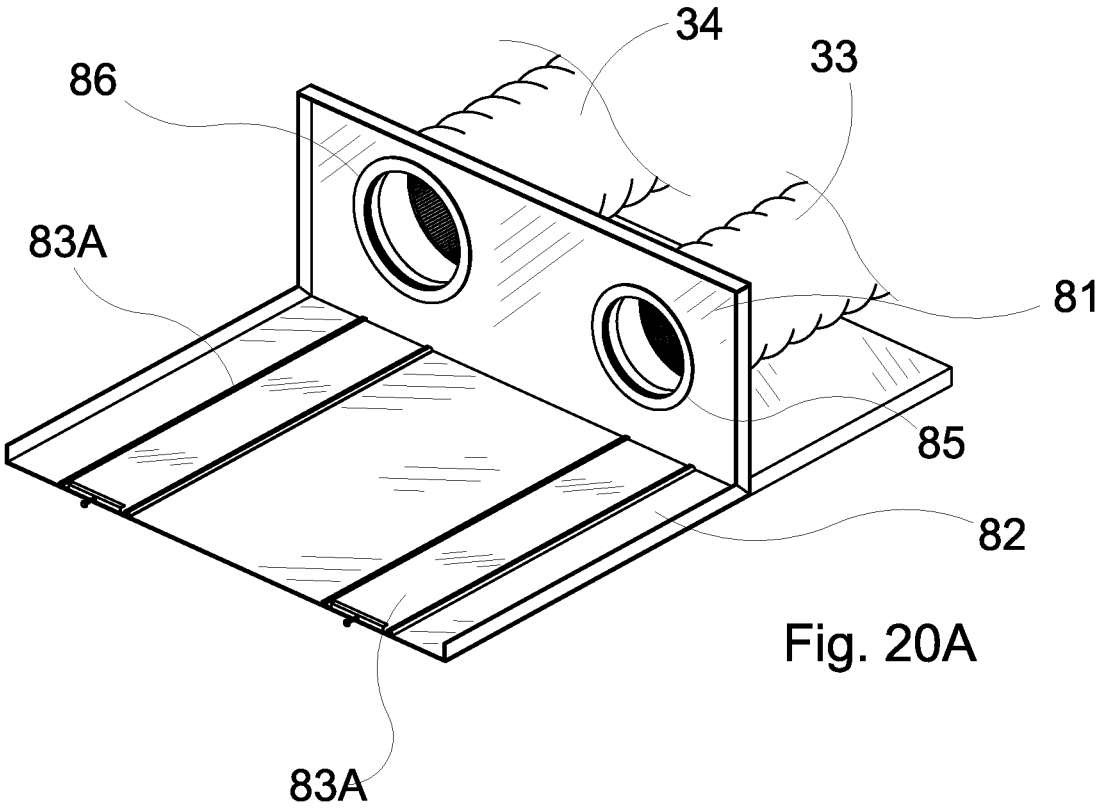
FIGS. 20A, 20B show the cabinet rail system of the manifold of FIGS. 14-17, 19.
Figure 20B:
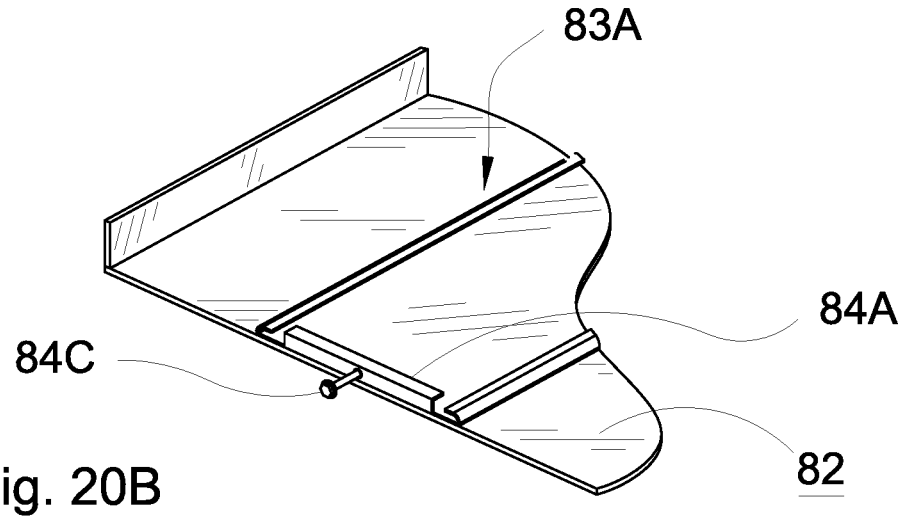

Couplers 85, 86 mate with intake and return ports 43, 44 disposed adjacent one another on one side of cabinet 41. Couplers 85, 86 comprise rubber gaskets disposed on bulkhead 81 and adapted to telescopically receive ports 43, 44 extending from cabinet 41 (and, optionally, port panels 56A, 56B). When seated, they form an airtight seal between flexible ducts 33, 34 and cabinet 41. A typical coupler 85, 86 adapted to surround ports 43, 44 appears in FIG. 18A, couplers 85, 86 having flange 87 from which annular collar 89 extends. Collar 89 is sized to concentrically surround ports 43, 44, forming a tight seal. Concentric inner cone 88 may be provided to journal inside ports 43, 44, and to guide ports 43, 44 into place. As seen in FIG. 18B, cone 88 may be trimmed to fit various sizes of ports 43, 44 and to optimize air flow therein. As seen in FIGS. 18C, 18D an alternate embodiment of cone 88 comprises a simple flange 87A bearing collar 88A mounts to port panels 56A, 56B and is adapted to mate directly with couplers 85, 86.

As best seen in FIGS. 14-17, manifold 80 is adapted to be installed between rafters 8 of mobile home 1 and to provide support for air handler unit 40 atop mobile home 1. Bulkhead 81 is sized to match the height of rafters 8 at the point at which manifold 80 is installed, thereby maintaining the profile of roof 3. One having ordinary skill in the art will recognize that manifold 80 likely spans a greater width than the typical spacing of rafters 8, and that one or more of rafters 8 may have to be truncated (rafter 8A) to admit manifold 80 between two adjacent rafters 8, one on either side of manifold 80. Bulkhead 81 comprises materials of sufficient strength to form a truss between two adjacent rafters 8 and thereby to maintain the integrity of roof 3. Thus, bulkhead 81 couples to truncated rafter 8A and secures it as would a dormer window.

Figure 22A:
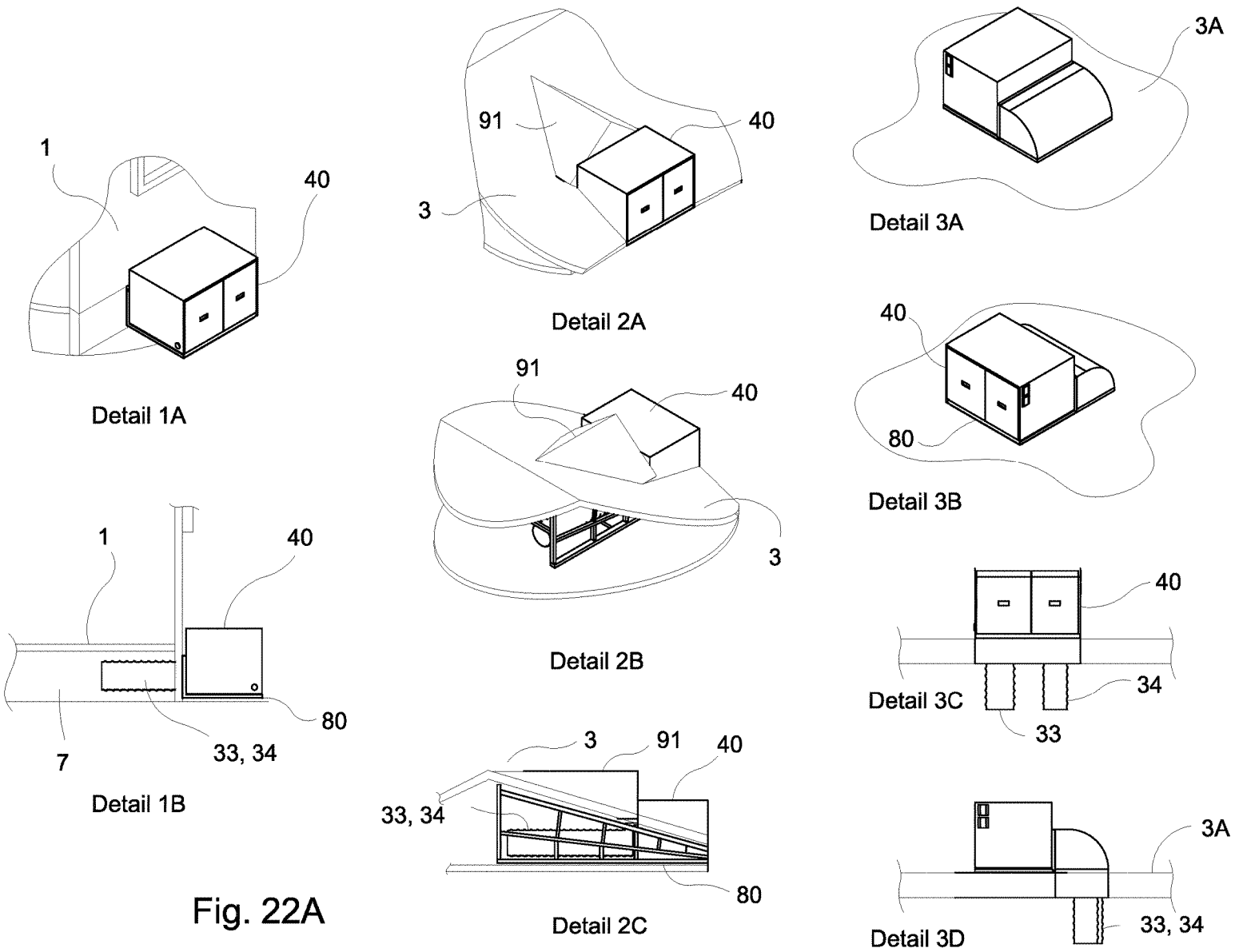
FIGS. 22A-22B detail various installation options for use with the present invention.

While manifold 80 creates a recess within roof 3 in which air handler unit 40 is installed, manifold 80 also maintains weather integrity of roof 3 by extending shelf 82 all the way to a position outside wall 5 (see FIGS. 1, 22A, Details 2A-2C). Dormer 91 may be provided to direct precipitation to either side of manifold 80, but one having ordinary skill in the art will recognize that it is not required. Precipitation falling on roof 3 runs onto shelf 82 and thereby off mobile home 1. Shelf 82 effectively forms an eave for roof 3 under air handler unit 40. Shelf 82 preferably slopes slightly downward from bulkhead 81 toward its terminus just beyond wall 5.

As means for easing installation and removal of unit 40 from manifold 80, rail system 83 (see FIG. 19) may be disposed substantially perpendicular to bulkhead 81 and extending for the length of shelf 82. At least two rails 83A preferably are provided, one each located a spaced distance from the other within the separation of the side walls of cabinet 41. Rails 83A mate with gliders 83B (see FIG. 21B) disposed on the bottom of cabinet 41 for easily aligning cabinet 41 and assuring a proper match of couplers 85, 86 with ports 43,44 without an installer (not shown) having to stand on roof 3 adjacent bulkhead 81 and mate them by hand. This in turn makes it possible for one installer (not shown) to remove and reinstall unit 40 alone, saving time and manpower.

One or more latch means preferably affixes at least one of gliders 83B to its corresponding rail 83A to maintain the integrity of the coupling between couplers 85, 86 and ports 43, 44. In a particular embodiment of such latches best seen in FIGS. 20A-21B, at least one transverse first latch bar 84A mounted to shelf 82 opposite bulkhead 81 includes longitudinal latch bolt 84C that mates with an appropriately sized, threaded hole in corresponding transverse second latch bar 84B (FIG. 21B) mounted to the access end of cabinet 41 across corresponding glider 83B. Latch bolt 84C not only secures cabinet 41 in place, it may be used to draw first and second latch bars 84A, 84B together and thereby to ratchet cabinet 41 into place once ports 43,44 engage couplers 85,86, thereby optimizing the seal between cabinet 41 and manifold 80. One having ordinary skill in the art will recognize that other latch means could be employed to similar effect without departing from the spirit and scope of the present invention.

Another advantage of manifold 80 arises from height constraints when mobile home 1 is transported on roads and highways. For obvious efficiencies, mobile home 1 manufacturers prefer to install air conditioning equipment at the factory instead of on site after a mobile home 1 has been sold and delivered. Manifold 80 enables this by providing means for such manufacturers (not shown) to install unit 40 within roof 3, then to remove it for transportation, sealing up bulkhead 81 during transportation. Alternately, where cabinet 41 is sufficiently short that its top 42 rises above shelf 82 no higher than the peak of gable 4, unit 40 may be installed at the factory and transported in place on roof 3 without requiring any site installation at all.

The present invention lends itself to myriad alternative applications than just the sloped roof installation shown and discussed in conjunction with FIGS. 14-17. For example, manifold 80 could be employed in the same context as manifold 50 discussed above for pad-mounted installations (FIGS. 5-7). In such case, shelf 82 could simply extend across and be supported by pad 23, allowing easy slidable installation using rails 83 on the ground.

Figure 22B:
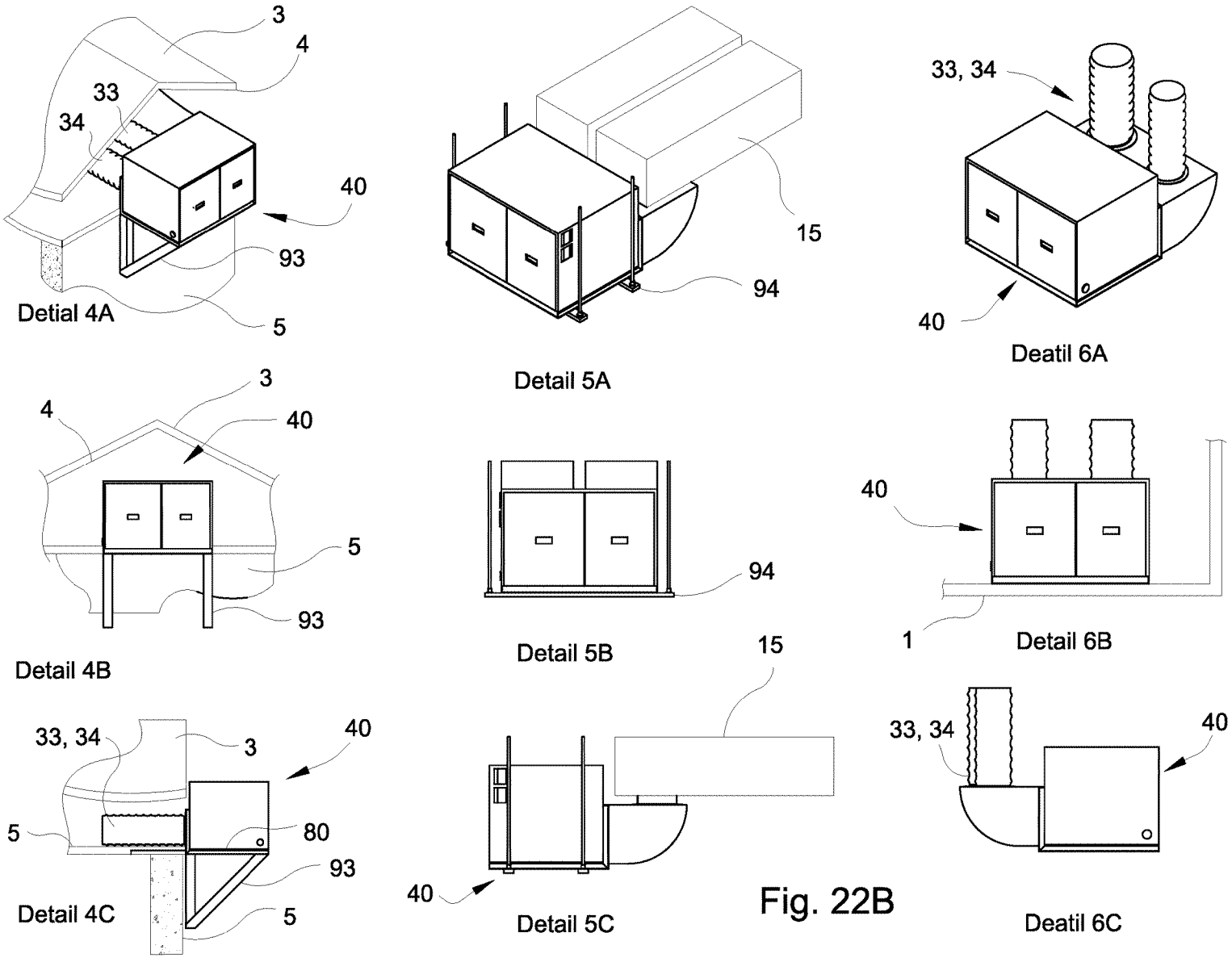
Figure 23A:
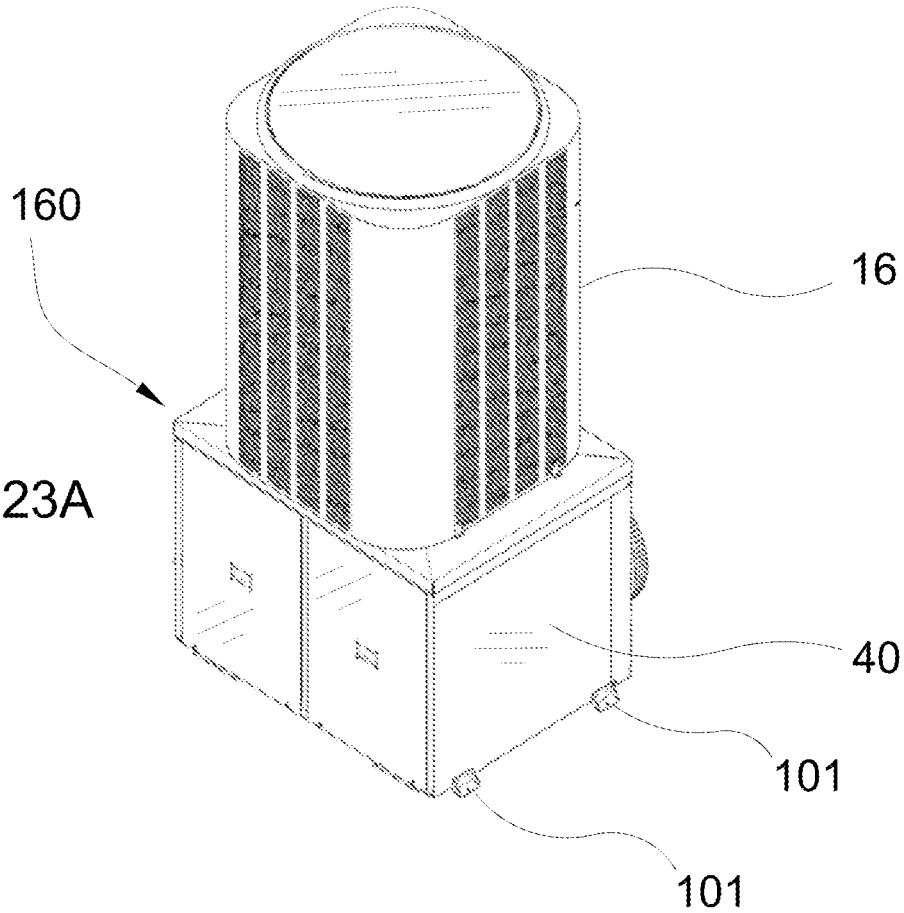
FIGS. 23A-23D show an alternate embodiment for the cabinet top adapter for stacking a condenser unit atop the present invention.
Figure 23B:
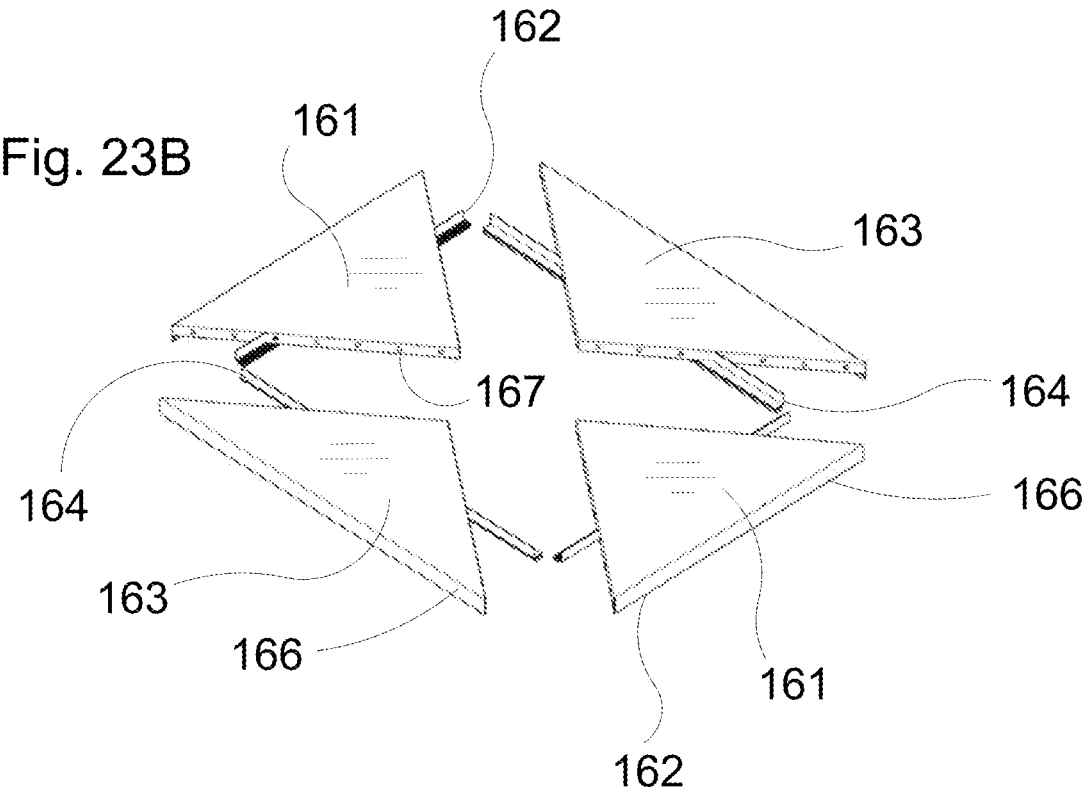
Figure 23C:
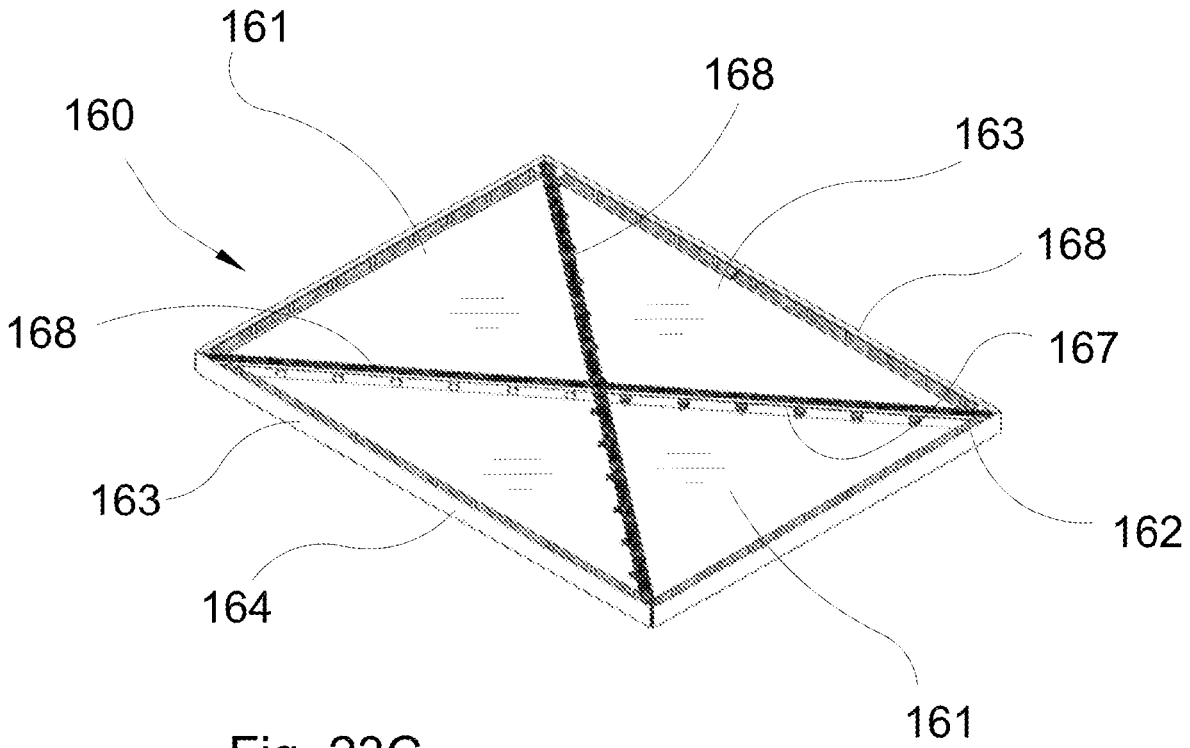
Figure 23D:
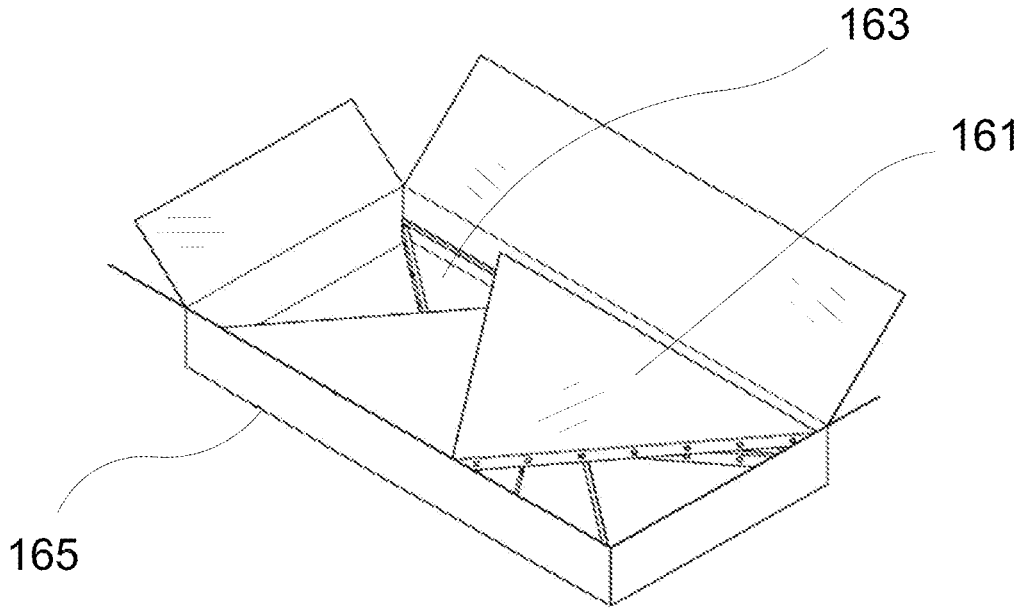
Figure 25A:
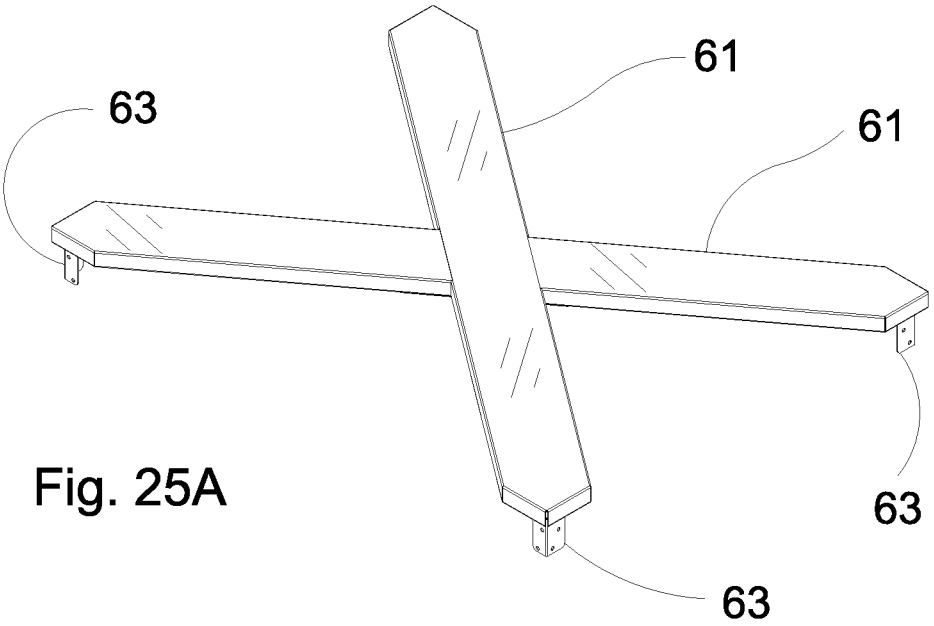
FIGS. 25A and 25B detail the X-bracket of FIGS. 10, 11.
Figure 25B:
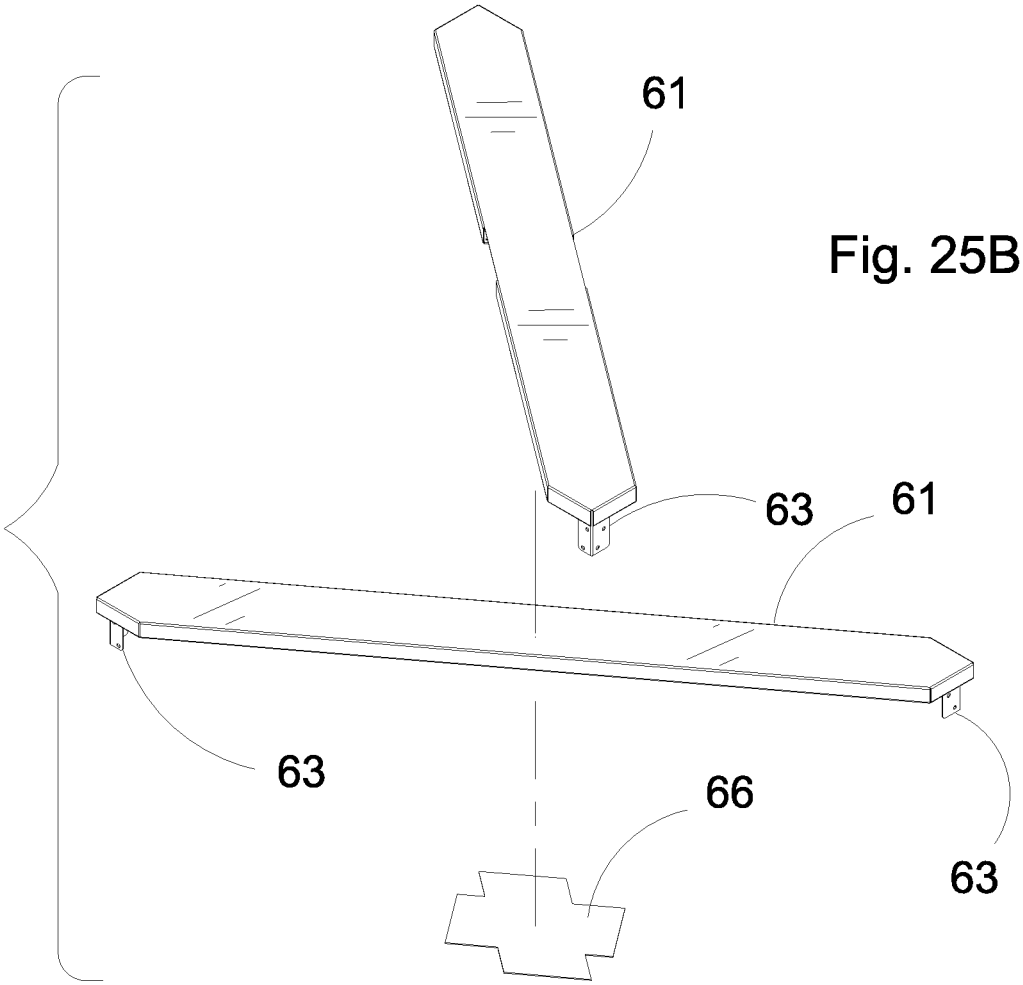

FIGS. 22A-22B depict a variety of other installation options using manifold 80. In FIG. 22A, Details 1A-2C depict the two alternatives discussed above. Details 1A-1B contemplate installation adjacent crawl space 7 and on pad 23. Details 2A-2C contemplate the roof mounted installation discussed above. Details 3A-3D contemplate installation of the present invention, using manifold 80, on a flat roof, where duct lines 33, 34 enter from the bottom. In FIG. 22B, Details 4A-4C contemplate support bracket 93 mounted high on wall 5 beneath gable 4 and supporting shelf 82, with bulkhead 81 substantially flush with wall 5 and flexible ducts 33, 34 extending into gable 4. Details 5A-5C contemplate hanging unit 40 from ceiling supports 94 attached to a ceiling inside a building (not shown), while Details 6A-6C contemplate installing unit 40 in a basement. One having ordinary skill in the art will recognize that condenser/compressor unit 16 may not be juxtaposed to most of the alternate installations of unit 40 depicted in FIGS. 22A-22B, but instead will be located an appropriate distance away and interconnected (not shown) by appropriate lengths of coolant lines 21, 22.

In operation, an installer (not shown) places manifold 50 adjacent a wall of mobile home 1 and couples it to cool and return air lines 33, 34 extending from duct work 15 through crawl space 7. Preferably this is a permanent connection. The installer then places universal air handler unit 40 adjacent manifold 50 and bolts manifold 50 to ports 43, 44. The installer then couples coolant lines 21, 22 between unit 40 and outdoor component 16, and then pressurizes and tests the system.

When alternate manifold 80 is being used in lieu of manifold 50, the installer supports shelf 80 on pad 23 with rails 82 extending substantially perpendicular to wall 5. The installer then places unit 40 atop shelf 82 a spaced distance away from bulkhead 81 and assures that gliders 83B engage rails 83A. The installer then slides unit 40 toward bulkhead 81 until couplers 85, 86 engage ports 43, 44, and them preferably latches gliders 83B to rails 83A using latch 84. The installer then proceeds to hook up coolant lines 21, 22 and to test the system, as described above.

For a rooftop installation, as discussed above in conjunction with FIGS. 14-17, an installer first installs manifold 80 between two rafters 8, as discussed above. One having ordinary skill in the art will recognize that this installer may be the manufacturer (not shown) of mobile home 1, as discussed above. At the appropriate time and place, another installer may proceed as discussed in the previous paragraph for manifold 80.

While the invention has been particularly shown and described with reference to preferred and alternate embodiments, it will be understood by those skilled in the art that various changes in form and detail may be made therein without departing from the spirit and scope of the invention. For example, the present invention has been discussed in connection with conventional air conditioning systems, but could just as well serve with heat pump systems. Also, for the roof installation discussed at length above, a second manifold (not shown) having bulkhead 81 and shelf 82, but not having couplers 85, 86, could be installed within roof 3 in similar fashion to manifold 80 and used to support outdoor unit 16 nearby to universal air handler unit 40, thereby minimizing the length of coolant lines 21, 22 and liberating space within curtilage 2.

I claim:

1. A method of installing a universal air handler for a building air conditioning system, the method comprising providing a coupling manifold adapted to be disposed adjacent said building, said coupling manifold having a bulkhead adapted to be disposed juxtaposed to said building and affixed to a conditioned air duct and a return air duct within said building, said bulkhead surrounding and defining a conditioned air port and a return air port;

a shelf coupled to said bulkhead by a proximate shelf edge and extending away from said bulkhead to a distal shelf edge;

providing said universal air handler having a cabinet having a cabinet bottom, a cabinet top and cabinet walls surrounding and defining a cabinet interior;

an evaporator coil dividing said cabinet interior into a conditioned air chamber and a return air chamber;

a blower positioned within said conditioned air chamber;

an outlet air port coupled to said conditioned air chamber and adapted to pneumatically couple to said conditioned air port;

an intake air port coupled to said return air chamber and adapted to pneumatically couple to said return air port;

installing said bulkhead juxtaposed to said building with said shelf extending away from said building; then coupling said conditioned air duct to said conditioned air port and said return air duct to said return air port; then positioning said universal air handler on said shelf with said outlet air port and said intake air port directed toward said bulkhead; then sliding said universal air handler across said shelf toward said bulkhead until said outlet air port couples to said conditioned air port and said intake air port couples to said return air port.

2. The method of claim 1 and further comprising providing a plurality of shelf rails disposed on said shelf and extending normal to said bulkhead, at least one of said plurality of shelf rails bearing a first transverse latch bar on a shelf rail end distal said bulkhead;

providing a plurality of glider rails disposed on said cabinet bottom and adapted to slidably mate with said plurality of shelf rails, at least one of said plurality of glider rails bearing a second transverse latch bar adapted to abut said first transverse latch bar;

then, as part of the positioning step, aligning said shelf rails with said glider rails;

then, as part of the sliding step, moving said air handler toward said bulkhead on said shelf rails and said glider rails;

then, after said sliding and moving steps, drawing said first transverse latch bar toward said second transverse latch bar until said first transverse latch bar and said second transverse latch bar abut each other.

3. The method of claim 1 and further comprising providing a condenser X-mount adapted to be affixed to said cabinet top;

then mounting the condenser X-mount to said cabinet top; then positioning a condenser atop said condenser X-mount.

4. The method of claim 1 wherein said building includes a plurality of building walls supporting a plurality of roof trusses supporting a building roof; and said installing step includes truncating at least one of said roof trusses a spaced distance from one of said building walls; then abutting said bulkhead against said at least one roof truss with said shelf extending across said one of said walls.

5. A method of installing a universal air handler for a building air conditioning system, the method comprising providing a coupling manifold adapted to be disposed adjacent said building, said coupling manifold having a bulkhead adapted to be affixed to a conditioned air duct and a return air duct within said building, said bulkhead having a conditioned air port and a return air port; and a shelf extending away from said bulkhead to a distal shelf edge;

providing said universal air handler having a cabinet having a cabinet bottom, a cabinet top, cabinet walls and a cabinet interior;

a conditioned air chamber and a return air chamber within said interior;

an outlet air port coupled to said conditioned air chamber;

an intake air port coupled to said return air chamber;

installing said bulkhead juxtaposed to said building with said shelf extending away from said building; then coupling said conditioned air duct to said conditioned air port and said return air duct to said return air port; then positioning said universal air handler on said shelf with said outlet air port and said intake air port directed toward said bulkhead; then connecting said outlet air port to said conditioned air port; and connecting said return air port to said return air duct.

6. The method of claim 5 wherein said universal air handler further comprises an evaporator coil dividing said cabinet interior into said conditioned air chamber and said return air chamber; and a blower positioned within said conditioned air chamber.

7. The method of claim 5 and further comprising providing a condenser adapted to couple to said universal air handler;

providing a condenser mount adapted to be affixed to said cabinet top;

then, mounting the condenser mount to said cabinet top;

then positioning said condenser unit atop said condenser mount.

8. The method of claim 7 wherein said condenser mount comprises an X-bracket having X-bracket legs disposed diagonally across said cabinet top and having X-bracket tips disposed substantially above said cabinet top; and lugs descending from said X-bracket tips and adapted to affix said X-bracket tips to said cabinet top.

9. The method of claim 8 wherein said lug means comprises a plug adapted to be received within a plug aperture in said cabinet top; and a screw adapted to penetrate one of said cabinet walls adjacent said cabinet top and to intersect and secure said plug within said plug aperture.

10. The method of claim 7 wherein said condenser mount comprises an X-mount having four triangular panels, each of said four triangular panels having three panel edges, two of said three panel edges being of a first length and a third of said three panel edges having a second length;

panel flanges disposed on each of said three panel edges and extending normal to said triangular panels a spaced distance;

fasteners adapted to affix two of said three panel flanges to another two of said three panel flanges on two others of said four triangular panels, whereby said four triangular panels form a substantially planar surface coextensive with said cabinet top and having an X-mount perimeter; and before the mounting step, affixing said four triangular panels together with said three panel flanges affixed to another two of said three panel flanges; and the mounting step includes placing said four triangular panels atop said cabinet top.

11. The method of claim 10 wherein one of said three panel flanges on each of said four triangular panels disposed adjacent said X-mount perimeter is adapted to extend downward below said cabinet top to lie adjacent one of said cabinet walls; and the placing step includes extending each of said one of said three panel flanges of each of said four triangular panels disposed adjacent said X-mount perimeter below said cabinet top and affixing said X-mount to said cabinet walls.

12. The method of claim 5 and further comprising providing a plurality of shelf rails extending normal to said bulkhead, at least one of said plurality of shelf rails bearing a first transverse latch bar on a shelf rail end distal said bulkhead;

providing a plurality of glider rails on said cabinet bottom, at least one of said plurality of glider rails bearing a second transverse latch bar adapted to abut said first transverse latch bar;

then, as part of the positioning step, aligning said shelf rails with said glider rails;

moving said air handler toward said bulkhead on said shelf rails and said glider rails;

and drawing said first transverse latch bar toward said second transverse latch.

* * * * *